US006393768B1

(12) United States Patent
Roche et al.

(10) Patent No.: US 6,393,768 B1
(45) Date of Patent: May 28, 2002

(54) METHOD OF MAKING REACH-IN DOOR FOR REFRIGERATED MERCHANDISER

(75) Inventors: John M. Roche, Ballwin; John A. Behr, Augusta; John M. Rasch, St. Charles, all of MO (US)

(73) Assignee: Hussmann Corporation, Bridgeton, MO (US)

( * ) Notice: Subject to any disclaimer, the term of this patent is extended or adjusted under 35 U.S.C. 154(b) by 0 days.

(21) Appl. No.: 09/676,540

(22) Filed: Sep. 29, 2000

Related U.S. Application Data

(62) Division of application No. 09/276,456, filed on Mar. 25, 1999, now Pat. No. 6,148,563.

(51) Int. Cl.[7] ..... E06B 3/00
(52) U.S. Cl. ..... 49/506; 49/501
(58) Field of Search ..... 49/501, 70, 325, 49/381, 506; 52/171.3, 173.1, 208, 397, 398, 790, 789

(56) References Cited

U.S. PATENT DOCUMENTS

| | | | | |
|---|---|---|---|---|
| 1,975,895 | A | 10/1934 | Geyer | |
| 2,701,395 | A | 2/1955 | Barroerro | 20/35 |
| 2,834,999 | A | 5/1958 | Taylor et al. | |
| 2,987,782 | A | 6/1961 | Kurowski | |
| 3,091,819 | A | 6/1963 | Wheeler et al. | 20/16 |
| 3,124,848 | A | 3/1964 | Wheeler et al. | 20/16 |
| 3,161,925 | A | 12/1964 | Bertolini | 20/69 |
| 3,248,533 | A | 4/1966 | Watkins | 240/51.11 |
| 3,331,159 | A | 7/1967 | Cooke et al. | 49/371 |
| 3,381,340 | A | 5/1968 | Chapin, Jr. | 18/36 |
| 3,442,059 | A | 5/1969 | Kessler | |
| 3,448,260 | A | 6/1969 | Wince et al. | 240/93 |
| 3,507,074 | A | 4/1970 | Gallegos | 49/386 |
| 3,510,986 | A | 5/1970 | Berkowitz | 49/386 |
| 3,612,821 | A | 10/1971 | Stromquist | 219/218 |
| 3,662,429 | A | 5/1972 | Johnson et al. | |
| 3,673,735 | A | 7/1972 | Winsler et al. | 49/70 |
| 3,703,425 | A | 11/1972 | Delmonte et al. | 156/24 |
| 3,724,129 | A | 4/1973 | Stromquist | 49/70 |
| 3,837,119 | A | 9/1974 | Conneally et al. | 49/404 |
| 3,859,502 | A | 1/1975 | Heaney | 219/218 |
| 3,882,637 | A | 5/1975 | Lindenschmidt | 49/501 |
| 3,919,023 | A | 11/1975 | Bowser et al. | |
| 4,004,370 | A | 1/1977 | Heaney | 49/70 |
| 4,084,347 | A | 4/1978 | Brown | 49/397 |
| 4,109,432 | A | 8/1978 | Pilz | |
| 4,127,765 | A | 11/1978 | Heaney | 219/218 |

(List continued on next page.)

FOREIGN PATENT DOCUMENTS

| | | |
|---|---|---|
| CA | 580944 | 8/1959 |

*Primary Examiner*—Curtis Cohen
(74) *Attorney, Agent, or Firm*—Richard G. Heywood

(57) ABSTRACT

A method of forming a thermally insulated, transparent door for use on a reach-in merchandiser, in which said door has at least two glass lites, and which comprises providing a thermally and electrically insulating spacer member having an outer wall portion and an inner separator body portion, and forming angled notches in the separator body portion to define the respective corners of first and second glass lites; folding the spacer member at the angled notches around one of the glass lites with te body portion in surface contact with the inner glass lite surface and an edge flange of the outer wall portion in engagement with the adjacent marginal edge thereof, and bringing the free ends of the spacer member into juxtaposition and securing them together with locking means for holding the spacer member in assembled peripheral contact around the one glass lite; assembling another glass lite in surface contact with the body portion of the spacer member and in spaced relation with the one glass lite; and molding a non-metallic frame of a preselected polyurethane material to peripherally encase the assembled glass lites and spacer member and create an air-tight seal therebetween.

51 Claims, 15 Drawing Sheets

U.S. PATENT DOCUMENTS

| | | | | |
|---|---|---|---|---|
| 4,135,369 | A | | 1/1979 | Allgeyer et al. ..... 62/251 |
| 4,145,844 | A | | 3/1979 | Kaspar ..... 49/386 |
| 4,149,348 | A | | 4/1979 | Pyzewski |
| 4,151,696 | A | | 5/1979 | Knights et al. ..... 52/741 |
| 4,223,482 | A | | 9/1980 | Barroero et al. ..... 49/386 |
| 4,237,597 | A | | 12/1980 | Auger ..... 29/526 R |
| 4,249,517 | A | | 2/1981 | Schroeder et al. ..... 126/450 |
| 4,259,135 | A | | 3/1981 | Kulla ..... 156/293 |
| 4,260,876 | A | | 4/1981 | Hochheiser ..... 219/497 |
| 4,306,140 | A | | 12/1981 | Stromquist ..... 219/522 |
| 4,336,009 | A | | 6/1982 | Wolf ..... 425/116 |
| 4,369,631 | A | | 1/1983 | Abraham ..... 62/82 |
| 4,382,177 | A | | 5/1983 | Heaney ..... 219/522 |
| 4,416,086 | A | | 11/1983 | Niekrasz ..... 49/388 |
| 4,429,509 | A | | 2/1984 | Vachet et al. ..... 52/788 |
| 4,430,770 | A | | 2/1984 | Niekrasz et al. ..... 16/80 |
| 4,431,691 | A | | 2/1984 | Greenlee ..... 428/34 |
| 4,477,129 | A | | 10/1984 | Heaney ..... 312/116 |
| 4,478,003 | A | | 10/1984 | Flett ..... 49/63 |
| 4,561,625 | A | | 12/1985 | Weaver ..... 249/85 |
| 4,578,902 | A | | 4/1986 | Niekrasz et al. ..... 49/70 |
| 4,609,978 | A | | 9/1986 | Hsieh et al. ..... 362/335 |
| 4,626,185 | A | | 12/1986 | Monnet ..... 425/110 |
| 4,637,167 | A | | 1/1987 | Svensson ..... 49/386 |
| 4,644,454 | A | | 2/1987 | Herst et al. ..... 362/224 |
| 4,646,472 | A | | 3/1987 | Sugawara ..... 49/386 |
| 4,648,832 | A | | 3/1987 | Reilly et al. ..... 425/543 |
| 4,671,582 | A | | 6/1987 | Stromquist et al. ..... 439/31 |
| 4,686,806 | A | | 8/1987 | Bennett ..... 52/309.4 |
| 4,692,963 | A | | 9/1987 | Barroero ..... 16/275 |
| 4,695,420 | A | | 9/1987 | Grawley et al. ..... 264/265 |
| 4,696,078 | A | | 9/1987 | Stromquist ..... 16/301 |
| 4,753,043 | A | | 6/1988 | Bockwinkel ..... 49/501 |
| 4,760,621 | A | | 8/1988 | Stromquist ..... 16/85 |
| 4,831,780 | A | | 5/1989 | Bockwinkel ..... 49/504 |
| 4,905,347 | A | | 3/1990 | Worth ..... 16/308 |
| 4,948,206 | A | | 8/1990 | Fitzpatrick ..... 312/296 |
| 4,951,927 | A | | 8/1990 | Johnston et al. ..... 264/129 |
| 4,998,382 | A | | 3/1991 | Kostos et al. ..... 49/501 |
| 5,007,217 | A | | 4/1991 | Glover et al. |
| 5,016,146 | A | | 5/1991 | Kaspar ..... 362/92 |
| 5,035,085 | A | | 7/1991 | Mamelson et al. ..... 49/504 |
| 5,061,531 | A | | 10/1991 | Catalano ..... 428/34 |
| 5,097,642 | A | | 3/1992 | Richardson et al. ..... 52/171 |
| 5,113,628 | A | | 5/1992 | Richardson et al. ..... 52/171 |
| 5,228,240 | A | | 7/1993 | Barroero et al. ..... 49/386 |
| 5,255,473 | A | * | 10/1993 | Kasper et al. ..... 49/501 |
| 5,301,092 | A | | 4/1994 | Santosuosso et al. ..... 362/125 |
| 5,315,211 | A | | 5/1994 | Ditlevsen et al. ..... 315/50 |
| 5,471,372 | A | | 11/1995 | Mamelson et al. ..... 362/92 |
| RE35,120 | E | | 12/1995 | Heaney ..... 312/116 |
| 5,544,454 | A | | 8/1996 | Richardson et al. ..... 52/171.1 |
| 5,687,509 | A | | 11/1997 | Barroero et al. ..... 49/386 |
| 5,720,540 | A | | 2/1998 | Crown et al. |
| 5,879,070 | A | | 3/1999 | Severloh |
| 5,884,361 | A | | 3/1999 | Richardson et al. |
| 5,895,111 | A | | 4/1999 | Santosuosso et al. |
| 5,902,034 | A | | 5/1999 | Santosuosso et al. |
| 6,223,414 | B1 | * | 5/2001 | Hodek et al. ..... 29/527.1 |

* cited by examiner

METHOD OF MAKING REACH-IN DOOR FOR REFRIGERATED MERCHANDISER

This application is a division of patent application Ser. No. 09/276,456 filed Mar. 25, 1999 for Reach-In Door For Refrigerated Merchandiser, now U.S. Pat. No. 6,148,563.

BACKGROUND OF THE INVENTION (a) Field of the Invention

This invention relates generally to the commercial refrigeration art, and more particularly to improvements in glass front product merchandisers (so-called "reach-ins") which hold and display medium and low temperature foods, including specifically doors for such reach-in merchandisers.

(b) Description of the Prior Art

Frozen food merchandisers are designed with the primary objective of maintaining product temperatures in the display area at about 0° F. for frozen food and −10° F. for ice cream, which in the past have required evaporator coil temperatures in the range of −10° F. down to −35° F. Medium temperature merchandisers maintain fresh product temperatures generally in the range of 30° F. to 40° F.

Multi-shelf reach-in merchandisers for storage and display of fresh and frozen food products (including ice cream) provide a generally vertical display of the product for greater visibility and product accessability to shoppers. In order to prevent the escape of cold air into the shopping arena, the display area of the merchandiser is closed by a glass front door. Glass is a poor thermal insulator so the doors are conventionally formed by two or three spaced apart panes of glass, defining one or two air spaces to increase the thermal insulation of the door.

The air spaces must be sealed for maximum insulating effect, and to prevent entry of moisture into these air spaces. Moisture in the air space condenses on the cold glass and obscures viewing of the product in the merchandiser. In the past, sealing of the air space has been accomplished by forming a an "insulating glass unit" or "IG unit" (sometimes called a "glass pack") which consists of opposing glass panes (called "lights" or "lites") separated by a metallic spacer secured by a suitable polymer (e.g., polysulfide, polyisobutylene, etc.). The glass pack is placed in a metal frame to complete the door. Thus, the door assembly process involves two separate steps of forming sealed air spaces, followed by forming a metal frame. Metal is most typically used in the frame and in the spacers because it has a good strength-to-weight ratio. In addition, metal is an excellent moisture barrier and when used as a spacer seals the air space from moisture for many years. However, metal has two important drawbacks when used in reach-in doors. The first is that metal is a poor thermal insulator, and the second is that metal is an excellent electrical conductor.

Conventional attempts to attenuate thermal conduction through the metal in the door generally involve placing barriers in the path of thermal conduction. Others have attempted to partially or entirely replace the metal frame with a polymeric material having a substantially lower thermal conductivity. Examples of such doors are shown in U.S. Pat. Nos. 5,097,642 and 5,228,240. However, it will be noted that in these prior art attempts to reduce the metal used in the doors have not eliminated the metallic spacers, nor have they replaced the need for sealing glass lites before forming the frame.

The electrical conductivity of metal is a hindrance because electrical power is used to heat one or more surfaces of the glass lites in the door. Heating is needed in order to prevent condensation from collecting and obscuring vision through the glass panes of the door. For instance, the moisture in the relatively warm ambient air of the store readily condenses on the outside of the door if it were not heated. Also, when the door is opened moisture condenses on the cold inside glass surface. Without heating, this condensation would not clear quickly and so the view of the product in the merchandiser would be obscured. Typically, heating is achieved by placing a semi-conductive film (e.g., tin-oxide) on the inner surface of the outer glass lite in the door. Bus bars along opposing edges of the lite provide an electrical potential causing a current to flow through the film and produce heat. It is presently necessary to keep the wiring and bus bars supplying the electric power carefully insulated and isolated from the outer metal door frame and the inner metal spacer. This means that a portion of the heating film had to be eliminated at the edge margin where there would be contact with metal. The primary danger occurs when a glass lite is shattered thus exposing the wiring to human contact and electrical shock. Conventionally, expensive electrical circuit breakers, such as ground fault interrupts and fused links, have been used to prevent accidental electrical shock in case of glass breakage.

SUMMARY OF THE INVENTION

The method of forming a thermally insulated, transparent door for installation and use on a reach-in merchandiser, in which said door has at least two glass lites and which comprises the steps of: providing a thermally and electrically insulating spacer member having an outer wall portion and an inner separator body portion, forming angled notches in the separator body portion to define the respective corners of first and second glass lites; folding the spacer member at the angled notches around one of the glass lites with the body portion in surface contact with the inner glass lite surface and an edge flange of the outer wall portion in engagement with the adjacent marginal edge thereof, bringing the free end of the spacer member into juxtaposition and securing them together with locking means for holding the spacer member in assembled peripheral contact around the one glass lite, assembling another glass lite in surface contact with the body portion of the spacer member and in spaced relation with the one glass lite, and molding a non-metallic frame of a preselected polyurethane material to peripherally encase the assembled glass lites and spacer member and create an air-tight seal therebetween.

A principal object of the present invention is to provide a method of making a reach-in door for a product display merchandiser which has door and casing improvements, better thermal insulation, better low-glare lighting, safer electrical isolation, secure door hinging and closure features and improved manufacturing.

A more specific object is to provide a method for a reach-in door having low thermal conductivity in which air spaces between glass lites of the doors are effectively sealed upon formation of the molded door frame.

Another object of the invention is to provide a method for a reach-in door which maintains a barrier to moisture entering the air spaces between glass lites.

Another object is to provide a method for a reach-in door which is more thermally insulated and therefore more energy efficient.

Another object is to provide a method for a reach-in door incorporating electrically insulating means simplifying the construction and installation of the door necessary to permit heating of one or more glass lites of the door and to reduce the risk of accidental shock in case of breakage of the lites.

These and other objects and advantages will become apparent hereinafter.

DESCRIPTION OF THE DRAWINGS

In the accompanying drawings which form a part of this specification and wherein like numerals refer to like parts wherever they occur.

DESCRIPTION OF THE PREFERRED EMBODIMENTS

Figure 1:
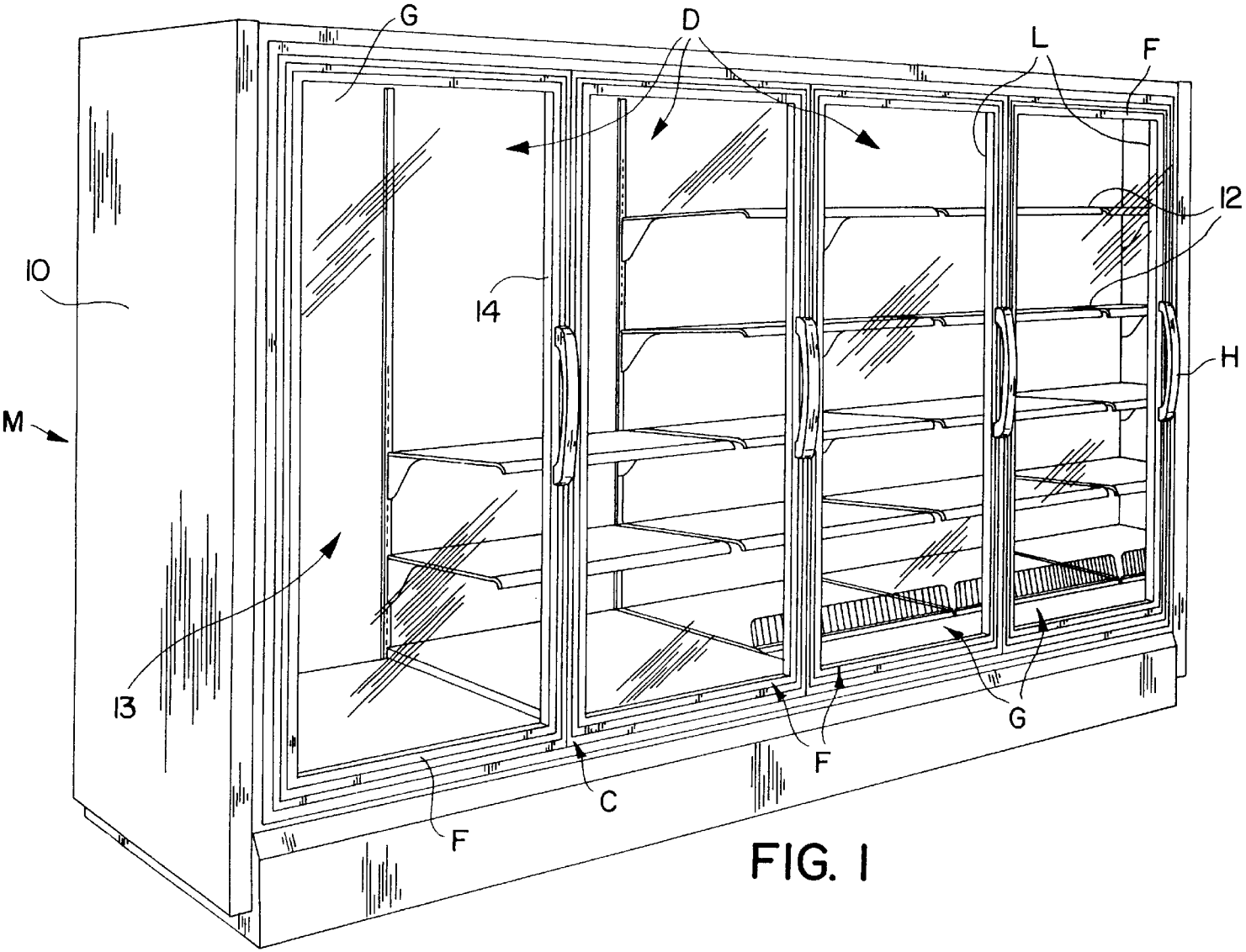
FIG. 1 is an perspective view of a refrigerated reach-in merchandiser.
Figure 2:
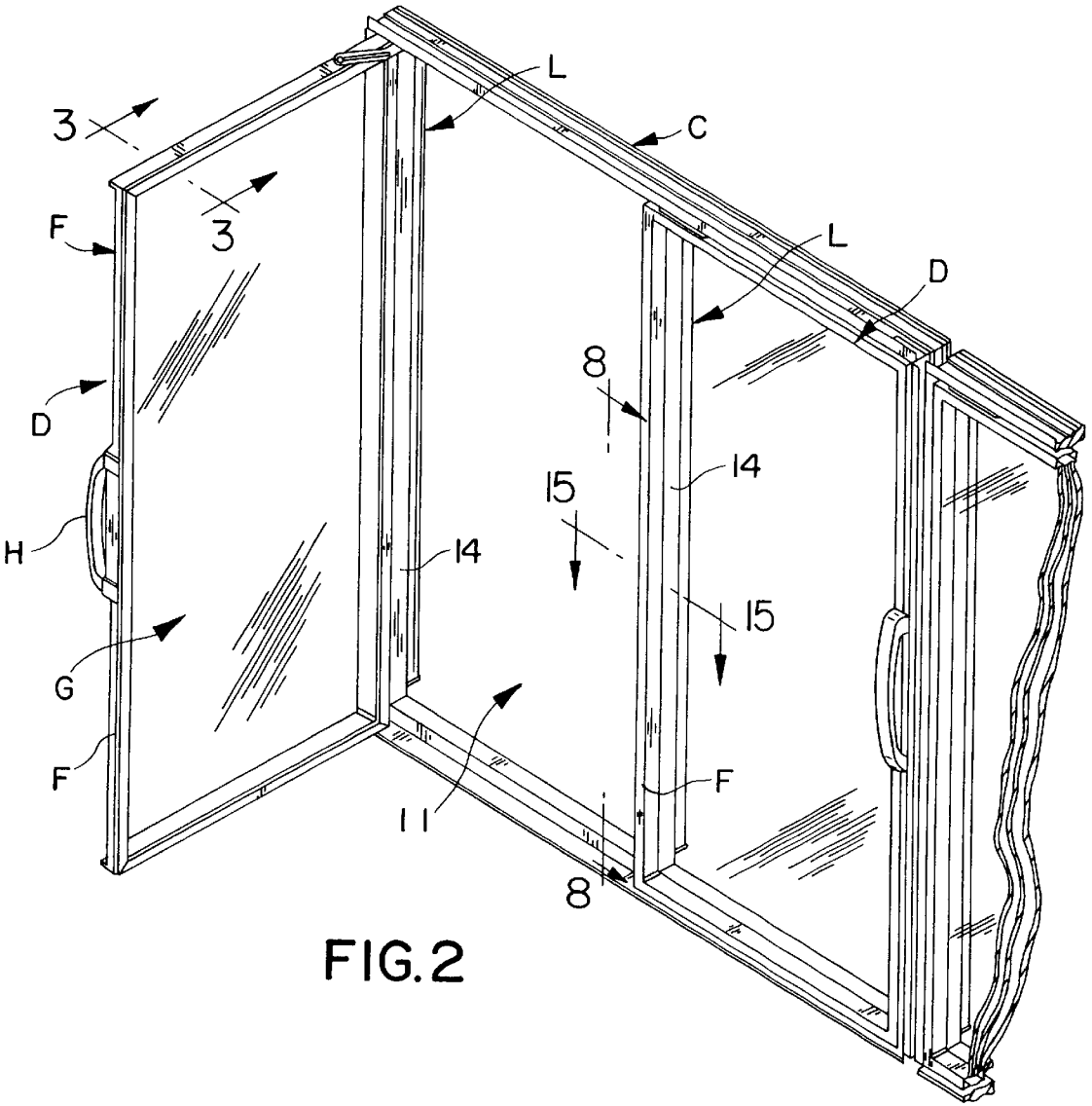
FIG. 2 is a fragmentary perspective view of reach-in doors and associated door casing of the merchandiser.

The present invention concerns improvements in reach-in merchandisers for medium and low temperature operation, and includes particularly improvements to thermal-type doors for such merchandisers and like temperature controlled enclosures. Referring to the drawings, and in particular to FIG. 1, a low temperature reach-in merchandiser is indicated generally at M for disclosure purposes. The merchandiser has an outer insulated cabinet having a front opening 11 (FIG. 2) defined by a cabinet casing C and closed by doors D hingedly mounted on the casing C. Multiple shelves 12 are selectively provided in the cabinet to hold and display product in the refrigerated interior product zone 13. As shown in FIG. 2, the doors D are opened by handles H to access the refrigerated zone 13 inside the merchandiser where product is held for display. The refrigerated zone 13 is illuminated by lighting L mounted on mullions 14 of the door casing C.

Figure 3:
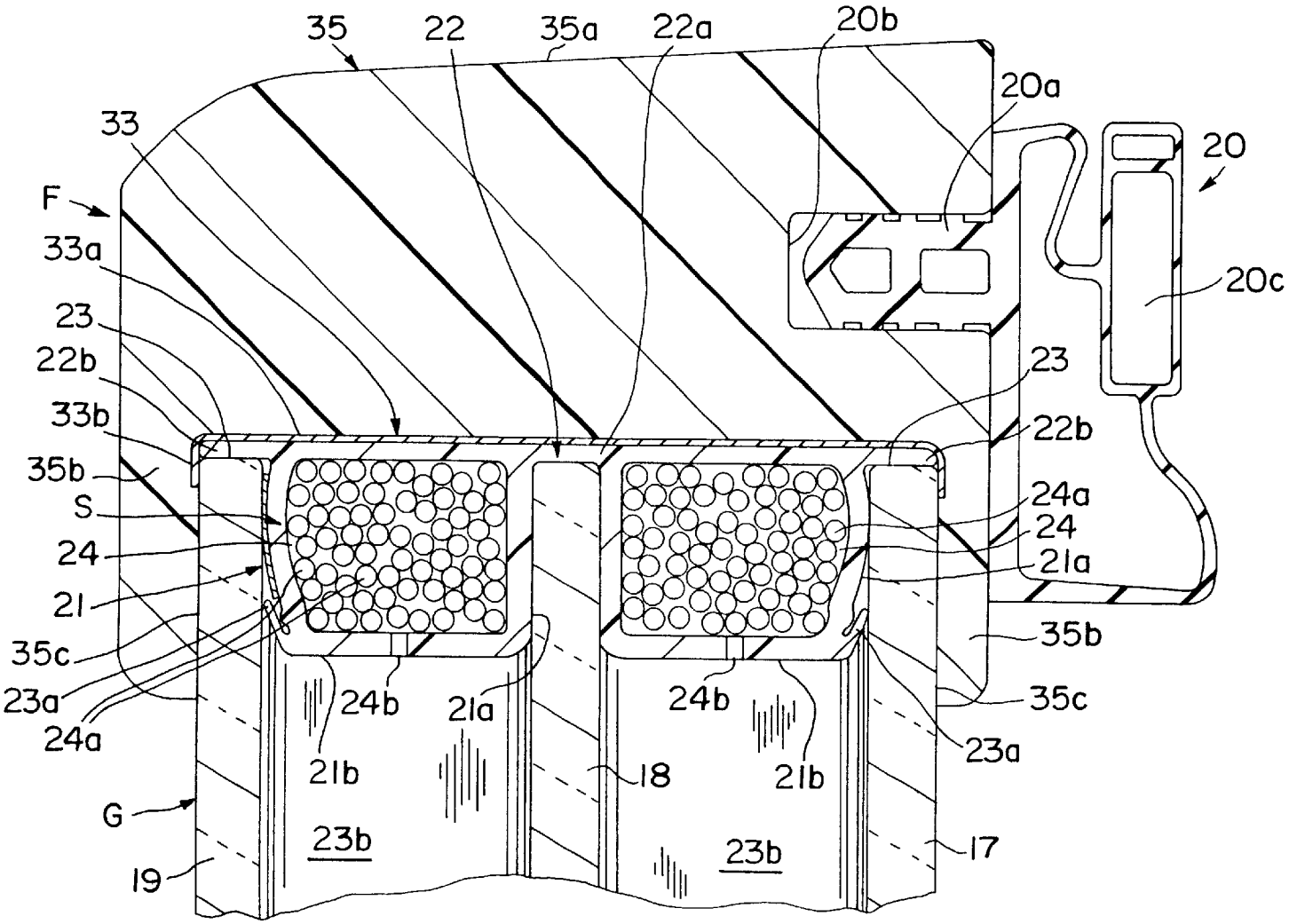
FIG. 3 is a greatly-enlarged fragmentary sectional view of a three lite reach-in door taken in the plane of line 3—3 of FIG. 2.

The reach-in doors D of the present merchandiser are transparent and have a finished molded door frame F of a suitable material, such as a reaction injection molded polyurethane, and do not require a metal frame or covering of any type. In the preferred embodiment, the framing material is polyurethane which has low thermal conductivity for minimizing thermal losses through the door frame, in addition to which it molds with a smooth, hard, glossy or textured surface finish. Referring to FIG. 3, the low temperature door further includes three panes or lites G of glass, namely an inner lite 17, a middle lite 18 and an outer lite 19 that are assembled and held together by the molded frame F. The precise number of lites may be other than described herein without departing from the scope of the present invention, but at least two lites would be used in the door. In an alternate embodiment, the middle lite is made of low-emissivity glass. A flexible magnetic strip holder 20 is attached to the frame F on an inside surface. The strip 20 has a continuous ridge 20*a* which is received in a channel 20*b* extending around the frame. Typical magnetic strips (not shown) are received in a pocket 20*c* of the magnetic strip holder 20. As known, the magnetic strips 20*c* releasably attach to metal plates 20*d* on mullions 14 and other door casing members to seal the door D against the casing C when the door is closed.

Figure 4:
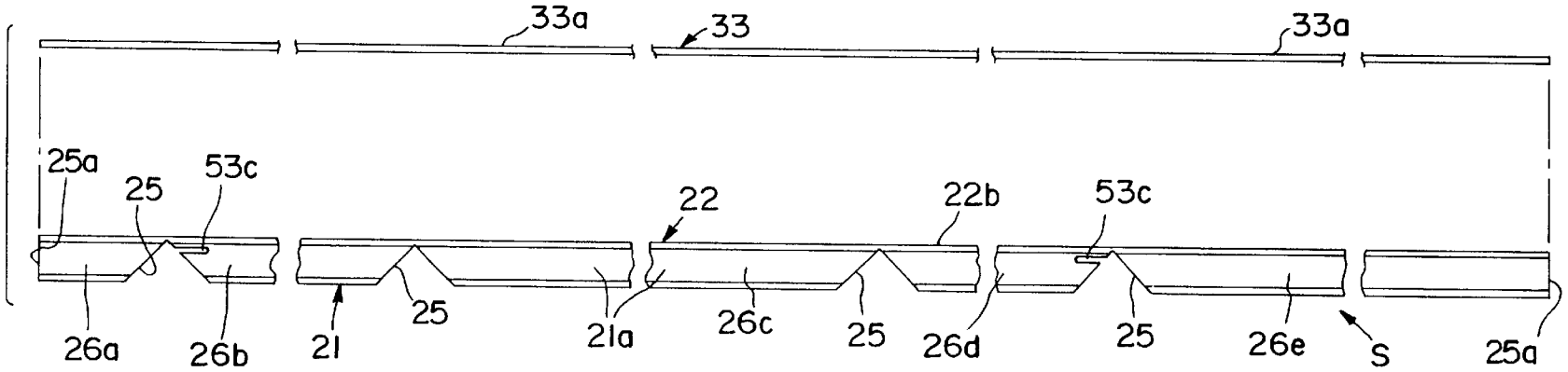
FIG. 4 is a fragmentary edge-on elevational view of a spacer member for the reach-in doors, laid out flat and showing a metal moisture sealing tape exploded above the spacer.

The glass lites are held in parallel spaced apart, generally face-to-face positions relative to each other by a spacer S to form a basic glass panel subassembly preliminary to molding the frame F. Referring to FIGS. 3 and 4, the spacer is made of polypropylene, or other suitable material, which has low thermal and electrical conductivity. In a three lite door, two separator or spacer body portions 21 of the spacer S are inwardly disposed between adjacent pairs of the glass lites (i.e. 17,18 and 18,19), and these portions 21 are joined together by an integral, unitary outer wall portion 22. The number of separator portions depends upon the number of glass lites to be spaced by the separator portions. Each separator or spacer body portion 21 has a generally D-shaped or rectangular configuration with spaced side walls 21*a* connected by a free inner wall 21*b* opposite to the outer wall member 22. The side walls 21*a* are engaged in surface contact with respective glass lites (17,18 or 18,19) adjacent to the free edge margins 23 thereof. In addition, sealing lip 23*a* is provided along the juncture of the outward side wall and free wall (21*a*,21*b*) of each spacer body 21 as an additional assurance of continuous sealing engagement of the spacer bodies 21 with the respective inner surfaces 17*a*,19*a* of the outermost glass lites 17,19. Continuous sealing contact of the spacer all the way around the lites is necessary to prevent molded material from encroaching the sealed air spaces 23*b* between adjacent lites during formation of the door frame F. The sealing lips 23*a*, as shown in FIG. 3, are deflected from their at rest positions when the separator portions are installed between adjacent glass lites.

The planar-outer wall 22 forms one wall of each spacer body 21 and has a connecting web 22*a* between the spacer bodies and also projects laterally outwardly to form flanges 22*b* at the outer longitudinal edges of the spacer. The laterally projecting flange portions 22*b* abut against the outer peripheral edge margins 23 of the inner and outer lites 17,19 in the door for additional sealing and also to maintain the spacer in position under frame molding pressure. Still referring to FIG. 3, the spacer bodies 21 are hollow (24), but filled with a suitable material for trapping moisture, such as a desiccant 24*a* (e.g., activated alumina). The inner wall 21*b* of each spacer body 21 has suitable holes or slots 24*b* spaced along its length to permit any moisture inside the air spaces 23*b* between adjacent lites to enter the hollow interior 24 and be adsorbed by the desiccant.

Figure 4A:
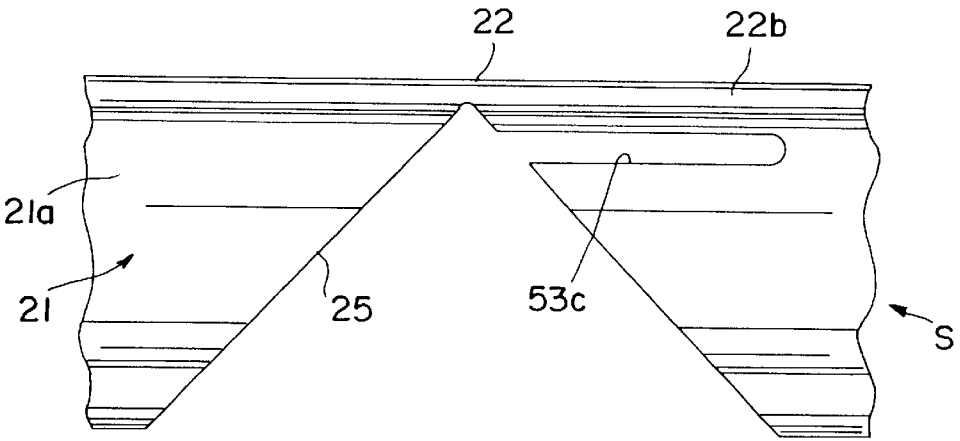
FIG. 4A is an enlarged view of a corner section of the spacer member configured for receiving a crossover electrical connector through the spacer.

Referring to FIGS. 4 and 4A, the spacer S is fabricated as a flat extruded strip with four angle-cut or chamfered notches 25 being formed in the spacer body 21 at locations corresponding to the four corners of the basic glass panel for the door D. The spacer S forms an outer peripheral covering for the three lites 17, 18, 19 by coming together at the corners (in the fashion of a miter joint) when the spacer is assembled around the lites so that the spacer segments extend continuously along the sides and mate together through the corners. The spacer S is constructed with five sequential segments identified in FIG. 4 as 26*a*–26*e*, and being interconnected at the angle cuts 25 by the continuous outer wall 22. Clearly, when the spacer S is folded or bent during assembly with the glass lites, the two alternate short segments 26*b* and 26*d* will be in opposed relation and form the short horizontal top and bottom walls of the panel. The long segment 26*c* will define the long vertical wall margin of the panel that will become the outer free handle margin of the door, and the two remaining segments 26*a* and 26*e* at the free ends 25*a* of the strip will close the inner hinged vertical margin of the panel, as now described.

Figure 5A:
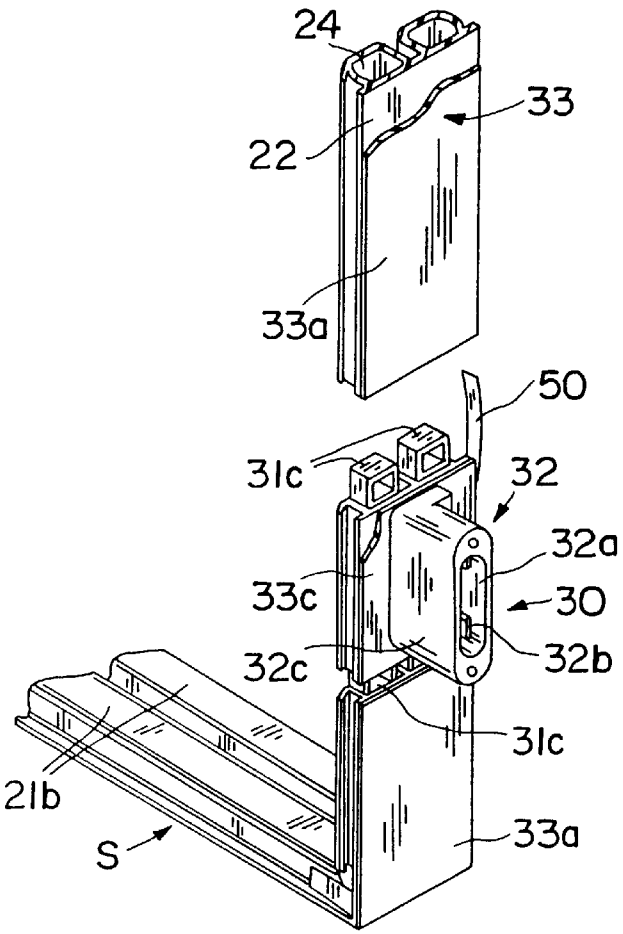
FIG. 5A is a fragmentary perspective view from the opposite side from FIG. 5.
Figure 5:
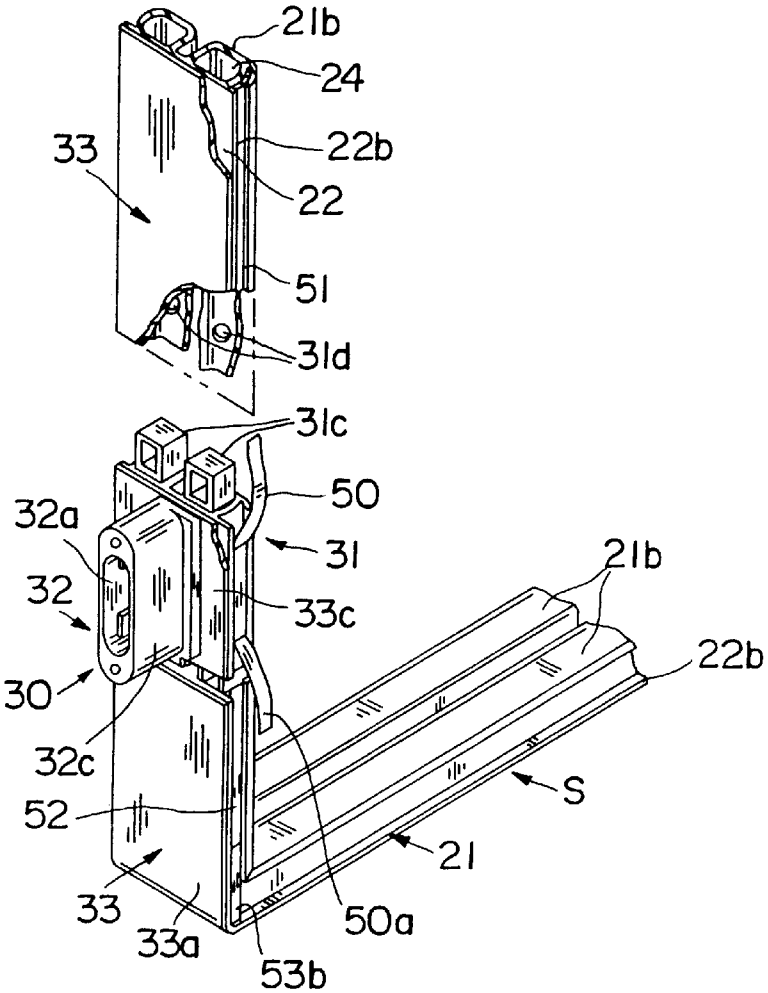
FIG. 5 is a fragmentary perspective view from a corner of the spacer as installed on the glass lites, and partially exploded to illustrate the assembly of the spacer ends by an electrical plug-in and spacer locking key for the door.
Figure 6A:
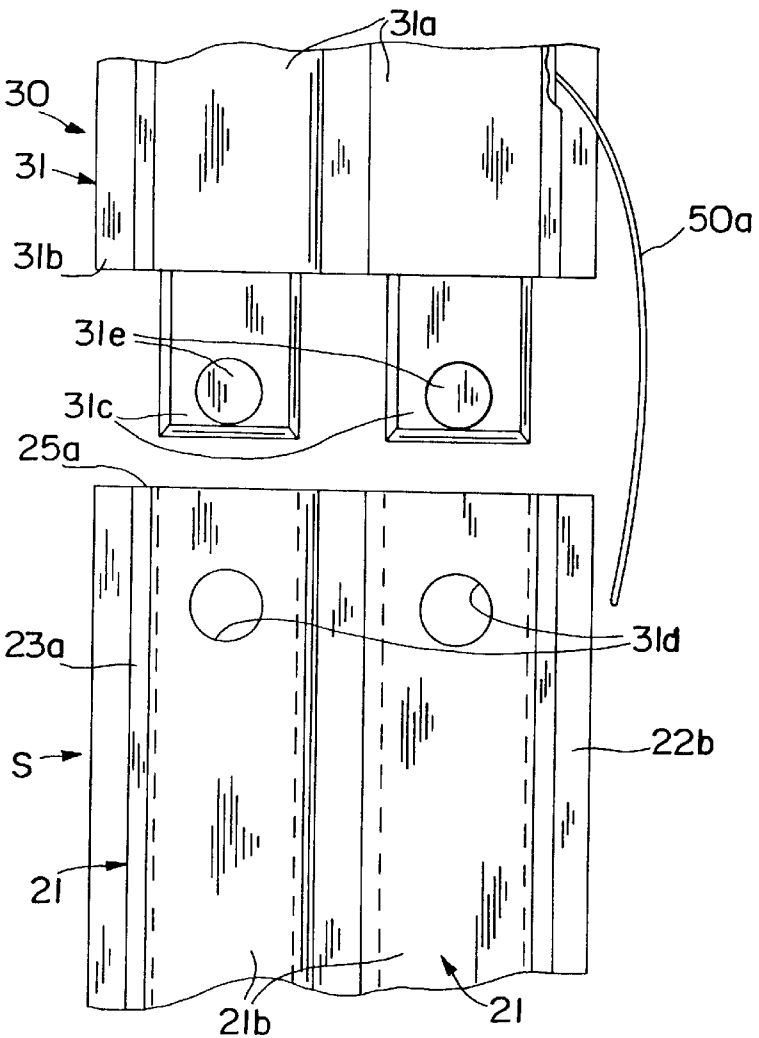
FIG. 6A is a greatly enlarged fragmentary view of the electrical plug-in and spacer locking key taken from the right side of FIG. 6.
Figure 6:
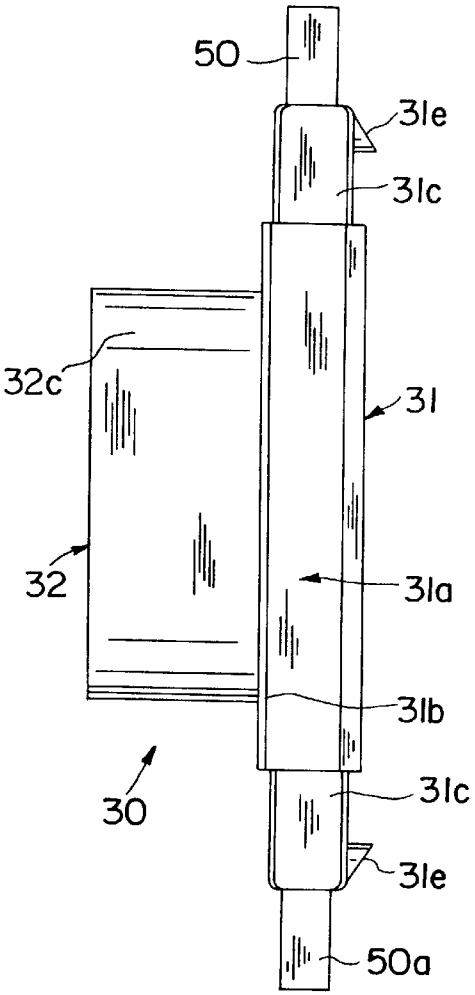
FIG. 6 is a side elevation of the electrical plug-in and spacer locking key of the spacer.

The free ends 25*a* of the spacer strip S are joined together by a unique electrical plug-in and spacer locking key 30, shown best in FIGS. 5, 5A, 6, 6A and 11–13. The key 30 has a main assembly or locking body section 31, and an electrical connector section 32 to be described later. The main body section 31 is constructed and arranged to mate with and join the free ends 25*a* of the spacer S, and it is configured with spaced separator body portions 31*a* and a connecting wall 31*b* with outer flanges to match the configuration of the spacer 21. Connector blocks or keys 31*c* project longitudinally from both ends of the separator bodies 31*a*, and these are sized to fit into the hollow cavities 24 of the spacer bodies 21 (FIGS. 5, 5A and 6A). In addition, the inner wall 21*b* of the spacer bodies 21 have an orifice 31*d* adjacent to their free edge 25*a*, and each key 31*c* has a chamfered locking detent 31*e* to snap lock into these holes 31*d* and form a secure interlock therewith. The spacer S is free of a bonded seal connection to the respective glass lites 17–19 except through the final molded door frame F, as will be described.

An important feature of the invention is the moisture barrier tape 33 which is applied to the outer surface of the outer wall 22 and flange 22*b*. This tape 33 may be an aluminum foil tape or, preferably, a thin, substantially non-metallic, moisture impervious polyester/polyethlene film that is electrically non-conductive. Referring to FIGS. 3, 4 and 5, the tape 33 has a main body 33*a* that covers the entire outer wall 22 of the spacer S and has an edge wrap that extends around the outer flange segments 22*b* and, preferably, onto the adjacent outer surfaces of the inner and outer lites 17,19. Thus, as shown in FIG. 4, the tape 33 may be provided as a unitary one-piece main body sheet 33*a* with integral edge wrap portions (33*b*) or as a series of main body sheets or segments corresponding to the five sections 26*a*—26*e* of the spacer strip 21. The foil or film sheets 33*a* may be applied to cover the outer wall 22 throughout its length so that the outer spacer wall surface is covered before it is assembled with the glass lites 17–19. In that event, the width of the tape or film would be only slightly greater than the width of the outer wall 22. The tape may wrap around and under the flanges 22*b* and would be in contact with the peripheral edge of the outer lites 17,19 when installed. The electrical plug-in and locking key 30 is also covered with the same film or tape 33*c*. The tape 33 provides a non-structural moisture barrier to inhibit significant transfer or migration of water vapor into the spaces 23*b* between the lites for many years. It is to be understood that other materials having the appropriate moisture barrier properties could also be used for the tape, in particular other films having moisture barrier and electrically non-conductive properties. It is possible to manufacture a door which has no such tape, but the lifetime of the door would be shortened by moisture ingress unless other materials for the spacers or the molded door frame with sufficiently low moisture permeability can be identified.

As indicated, the basic glass panel with assembled lites, spacer and moisture barrier tape is encased in the outer molded door frame F. As shown in FIG. 3, this frame F has a main body portion 35 that surrounds the periphery of the glass panel subassembly, and has an outer wall margin 35*a* and side walls 35*b* that extend inwardly and capture the outer glass surface margins (35*c*) of the inner and outer lites 17,19.

The reach-in door D is mounted on the door casing C of the refrigerated merchandiser M for swinging motion between a closed position in which the door covers the encased front opening 11 in the cabinet 10 (center door in FIG. 2), and an open position for access to the refrigerated display zone 13 within the cabinet (left door in FIG. 2). Referring to FIGS. 7, 7A, 9 and 9A, the hinging means for mounting the door D are accommodated during the frame molding process by forming an upper cylindrical opening 38 receiving a metal sleeve or bushing 38*a* and a lower cylindrical opening 39 receiving a sleeve or bushing 39*a*. After completion of molding the frame F around the glass lite subassembly, the upper bushing 38*a* preferably receives a plastic sleeve 38*b* (FIG. 9) in which an upper hinge pin 40 is slidably received for free turning movement so that this hinge pin is free of any fixed connection to the molded frame F. The bushing 38*a* contains a compression spring 40*a* which biases the pin 40 for vertical outward movement relative to the frame F so that the pin projects upwardly to be received into an opening 40*d* in an upper mounting plate 40*b* attached by bolts 40*c* to the door casing C of the merchandiser M (FIG. 9B). The bolts 40*c* are received through respective elongate slots 40*e* located at offset positions in the upper mounting plate 40*b* and are secured into the casing C. The elongation of the slots 40*e* permits the upper mounting plate 40*b*, and hence the position of the hinge pin opening 40*d* to be moved laterally from side to side on the door casing. In this way the pivot axis of the door D can be adjusted for optimum alignment within the casing opening. The pin 40 has a notch 40*f* sized to receive the end of a screwdriver for camming the pin downwardly into the sleeve 38*a*, 38*b* against the bias of the spring 40*a* and out of the opening 40*d* in the upper mounting plate for removing the door D from the merchandiser M.

Figure 7:
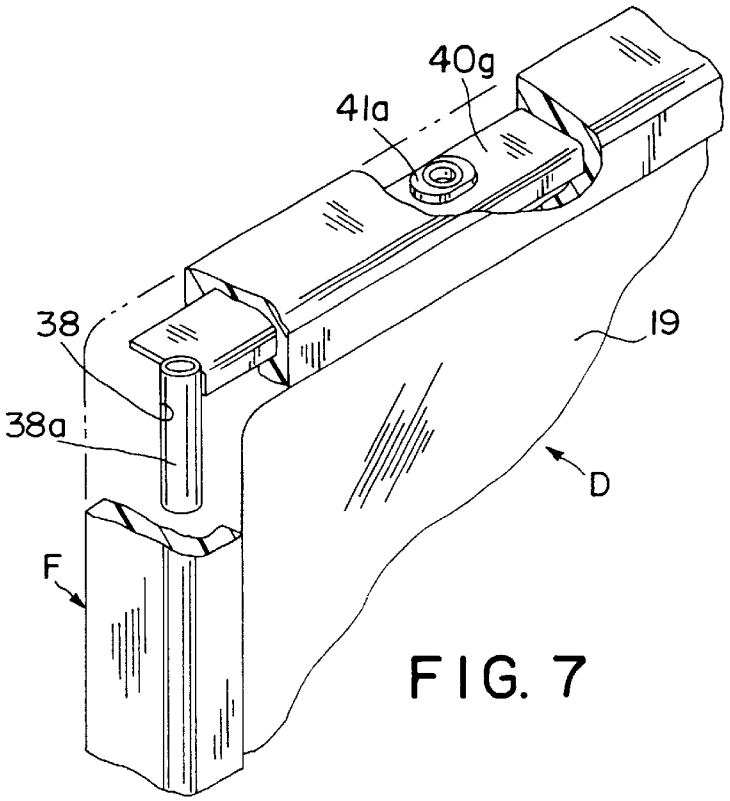
FIG. 7 is a fragmentary perspective view of an upper corner of a reach-in door partly broken away to illustrate an upper hinge reinforcement.

The upper bushing sleeve 38*a* for the upper hinge pin 40 may be part of an upper reinforcing member 40*g* molded into the door frame (FIG. 7). The reinforcing member 40*g* is preferably a shaped metal plate or other suitable high strength structural material and the sleeve 38*a* is secured to it. The use of a reinforcing member 40*g* is to rigidify and strengthen the frame F in the region of the upper door mounting connection and permits forces on the door to be translated and distributed over a wider area of the molded frame F. The member 40*g* also provides a bearing portion (41*a*) to receive a pivot pin 41*b* to connect one end of a hold open bar 41 to the door. The hold open bar 41 limits the maximum angle of opening of the door relative to the merchandiser, and functions to hold the door fully open when needed (e.g., as for stocking the merchandiser). The left-hand door D is shown in its fully open position in FIG. 2. The hold open 41 is pivotally connected to the casing C by a bolt 41*c* at a first end. Typically, the sliding pin is received in a slot near a second end of the hold open and slides along the slot as the door is opened and closed. A narrow neck (not shown) near the end of the slot separates a main portion of the slot from a circular hold open portion (not shown). The hold open has a slit at the end so that the hold open is able to expand to permit the slide pin to pass by the neck and into the hold open portion. The neck prevents the door from closing unless sufficient force is applied to push the pin back through the neck.

Figure 7A:
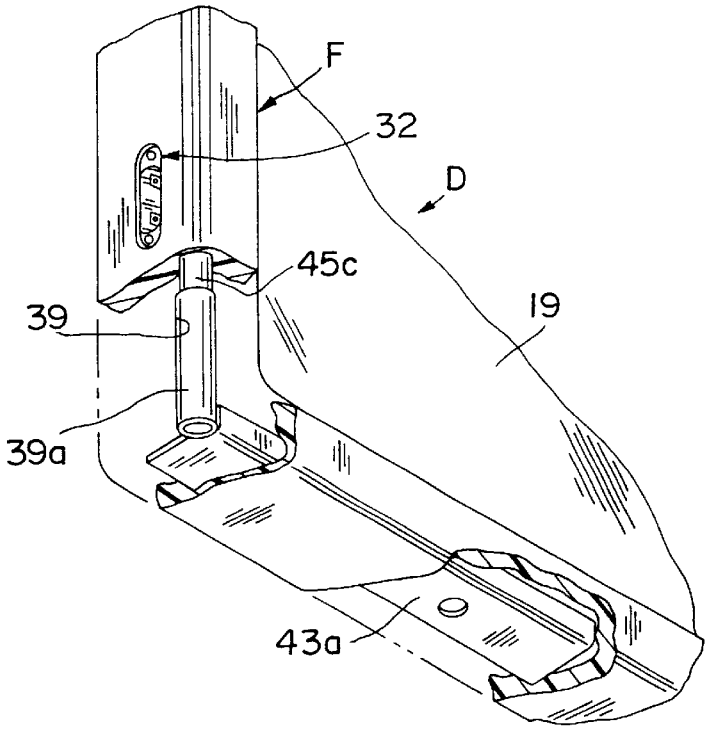
FIG. 7A is a fragmentary perspective view of a lower corner of the reach-in door partly broken away to illustrate a lower hinge reinforcement.
Figure 8:
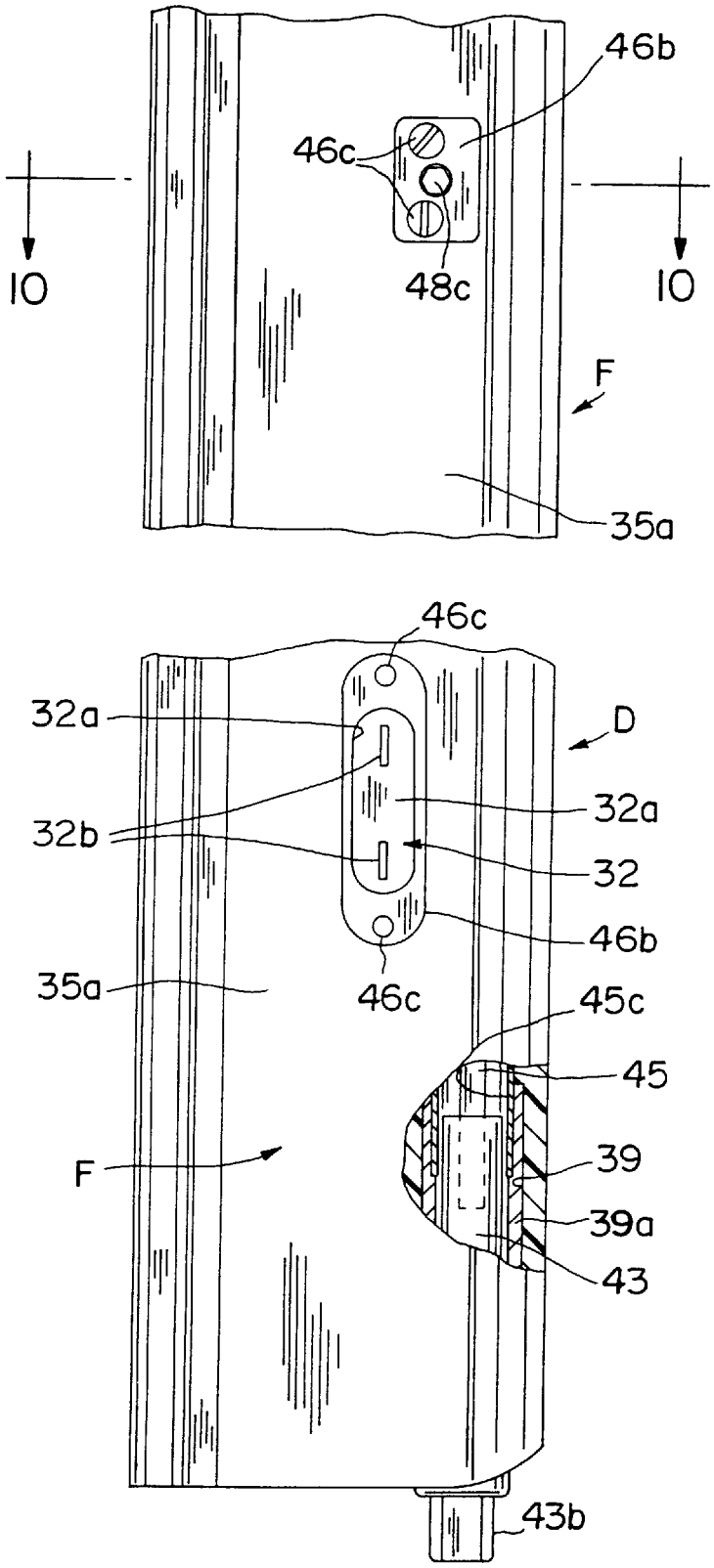
FIG. 8 is a fragmentary elevational view of the hinging margin of the reach-in door with parts broken away to reveal a torsion bar, as referenced by line 8—8 of FIG. 2.
Figure 9:
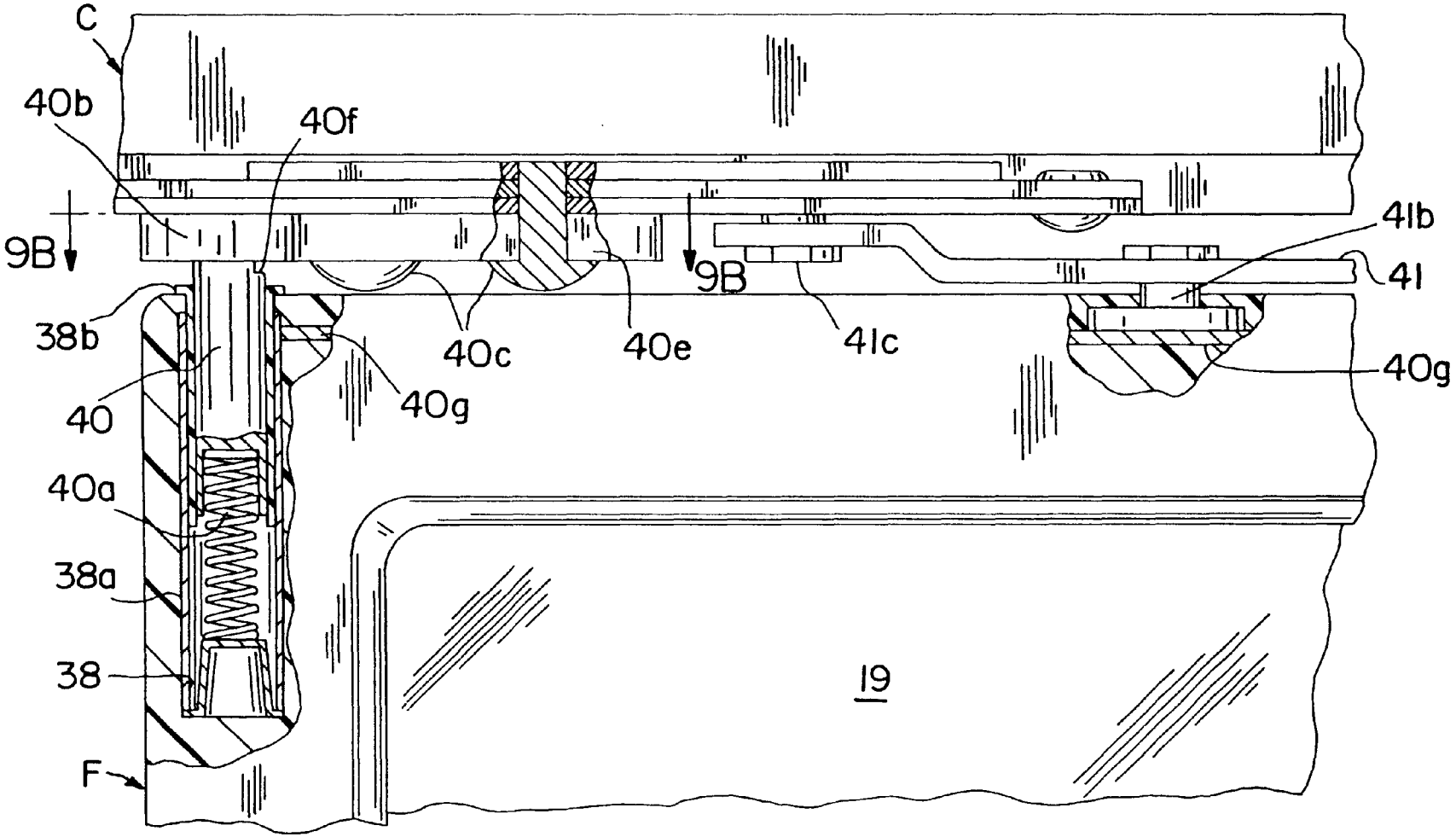
FIG. 9 is a fragmentary elevational view of the upper corner of the reach-in door and door casing, with parts broken away to show details of construction.
Figure 9A:
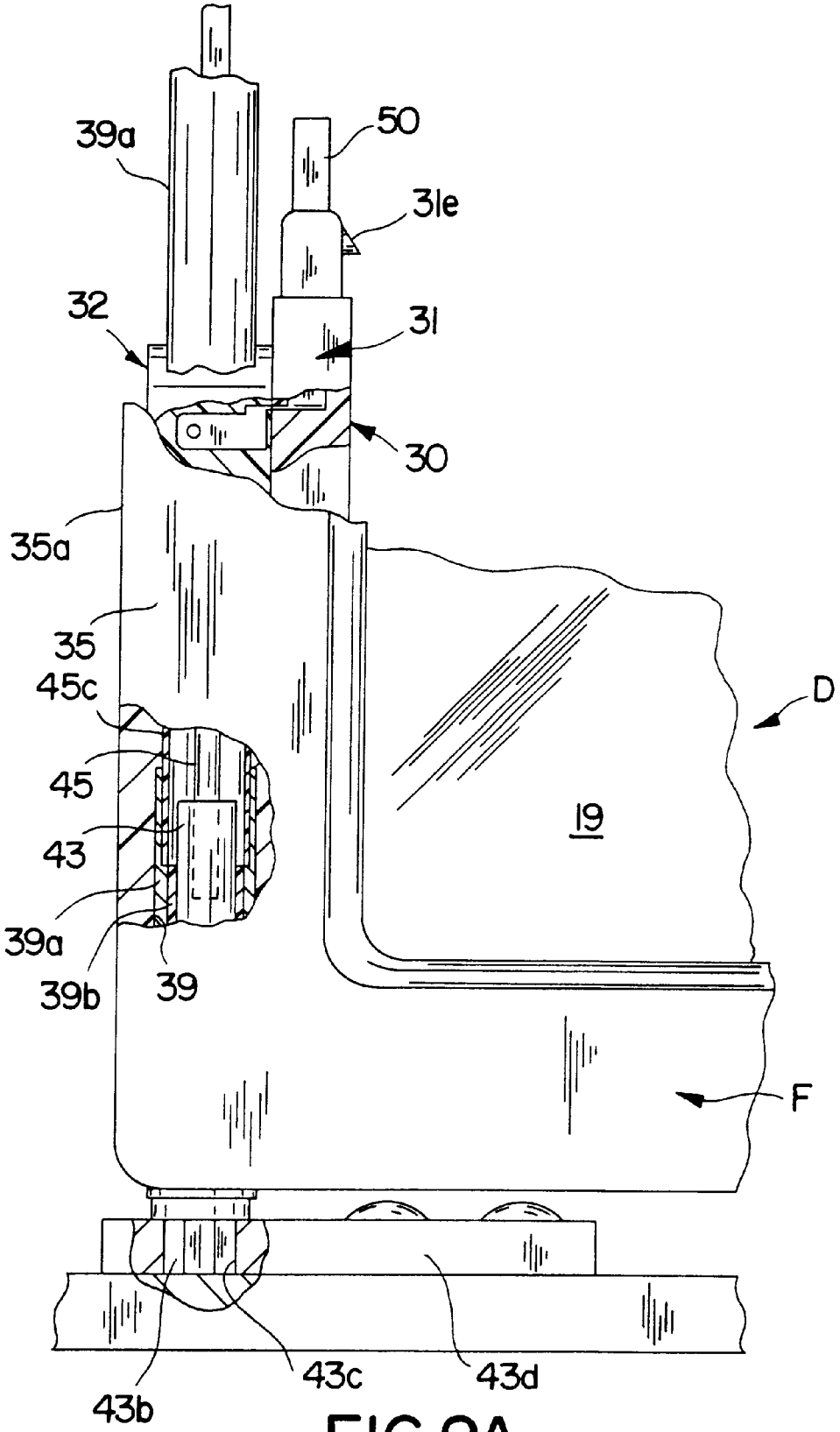
FIG. 9A is a fragmentary elevational view of the lower corner of the reach-in door and door casing, with parts broken away to show details of construction.
Figure 9B:
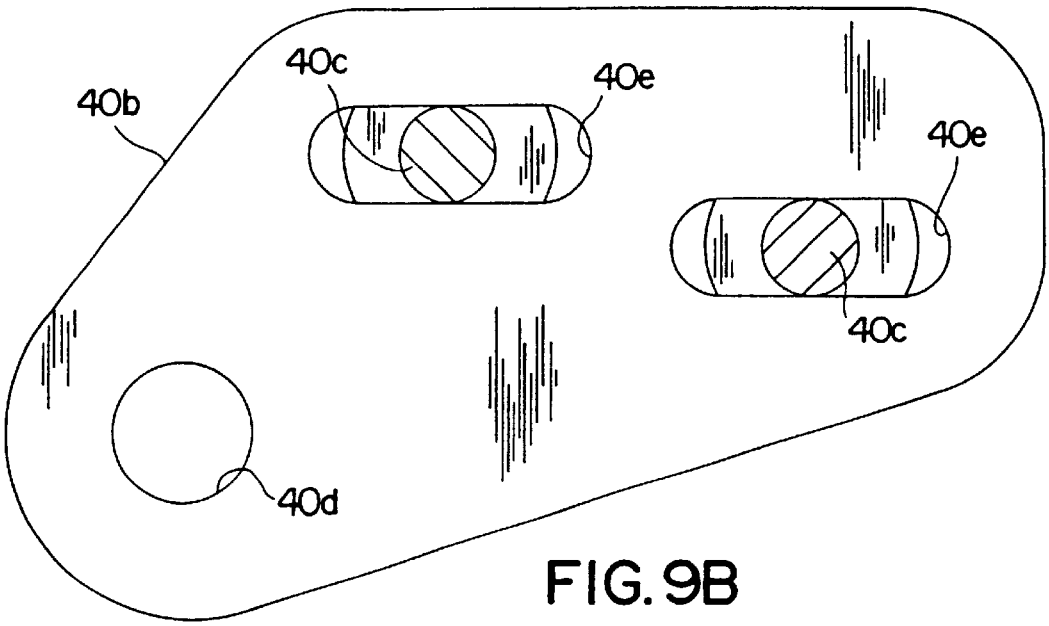
FIG. 9B is a top plan view of a hinge plate as taken along line 9B—9B of FIG. 9.

As shown in FIGS. 7A, 8 and 9A, the lower hinge pin 43 is provided for during the frame molding process by forming the lower cylindrical opening 39 for the bushing 39*a*, and after the molding process a plastic sleeve 39*b* is received in the metal bushing as a bearing for the lower hinge pin 43 which is free of any fixed connection to the molded frame F. The lower bushing 39*a* may be secured to a lower reinforcing member 43*a* (FIG. 7A) for reinforcing the frame F in the door mounting area where the major weight of the door D is translated to the casing C. The reinforcing member 43*a* is preferably molded into the frame F. The lower end 43*b* of the hinge pin projects outwardly below the frame F and is hexagonal (or otherwise shaped) to have a non-rotational fit into a complementary opening 43*c* in a casing bearing plate 43*d* bolted to the casing C. Thus, the door D will turn on the lower hinge pin 43 as it is opened and closed while the lower hinge pin is stationary relative to the cabinet casing C.

Figure 10:
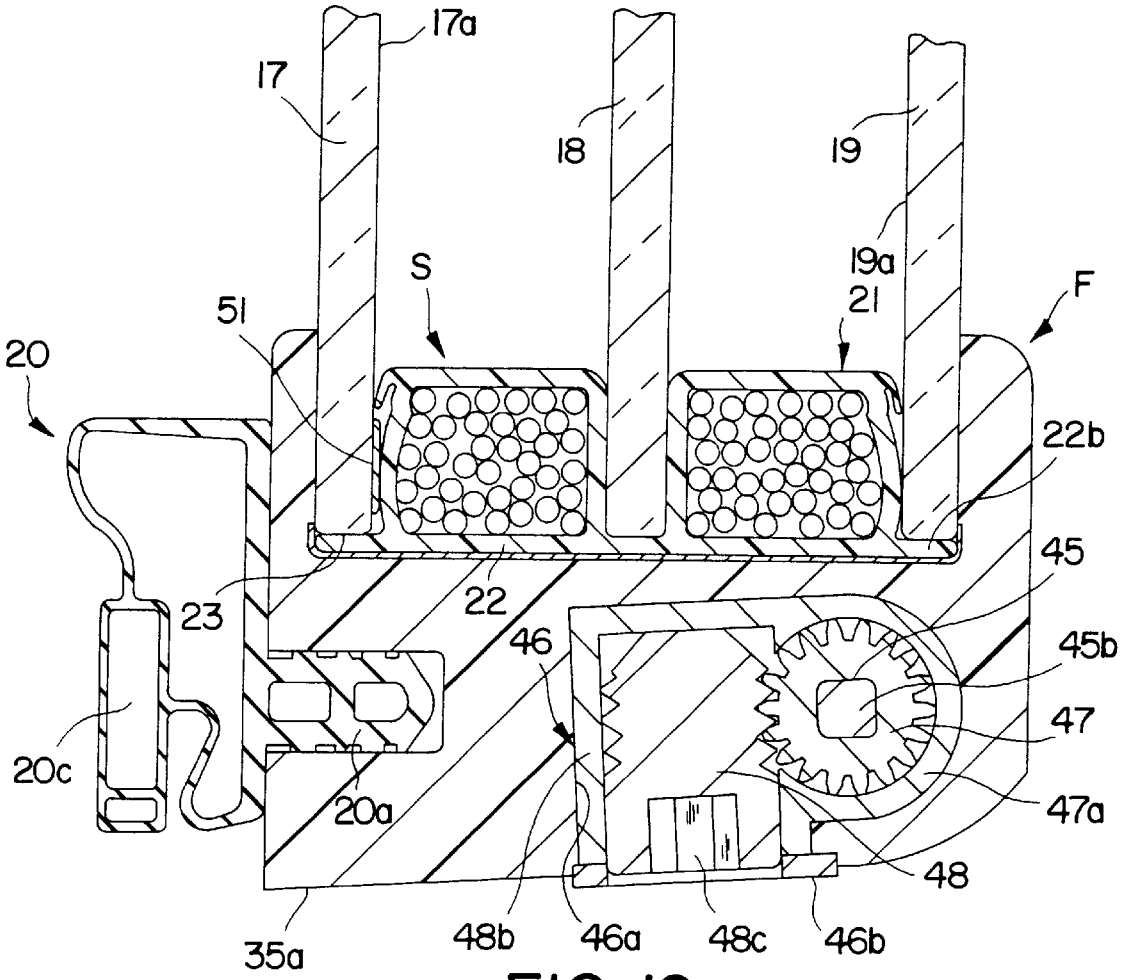
FIG. 10 is a fragmentary sectional view taken in the plane of line 10—10 of FIG. 8 and shows a torsion bar adjustment feature of the door.

A torsion rod 45 is fixedly attached at its lower end to the lower hinge pin 43 whereby the lower end of the torsion rod is held from rotation relative to the lower hinge pin and casing C. The torsion rod 45 is an elongated spring steel member of square cross-section or the like (FIG. 10) which functions to bias the door D toward its closed position. To that end, the upper end 45*b* of the rod 45 is fixed for conjoint pivoting movement with the door. Referring now to FIGS. 8, 9A and 10, the upper end 45*b* of the torsion rod 45 is positioned in a torque adjustment housing 46 mounted in a recessed opening 46*a* formed in the hinge margin 35*a* of the molded frame F at a vertically central location of the door (FIG. 8). A cover plate 46*b* has two screws 46*c* to mount the cover plate over the housing 46 in the frame. The upper end of the torsion rod 45 has a spur gear 47 rotatably positioned in an arcuate housing section 47*a*, and the teeth of the spur gear 47 entrain with the helical tooth of a worm gear 48 in the adjacent housing section 48*b*. The worm gear 48 is turned by a recessed Allen head screw 48*c* to turn the spur gear 47 and upper end of torsion rod 45 to torque the rod about its longitudinal axis and either increase or decrease the amount of torsional deflection of the torsion rod. The more the torsion rod is twisted about its axis, the greater latent spring closing force the torsion rod 45 exerts on the door. The provision of the adjustment housing and worm gear in the door provides for easy access to adjust the closing force of the door as necessary. As will become more apparent in the description of the door molding process hereinafter, provision is made to accommodate the torsion rod 45 and the torque adjustment housing 46 by creating the lower cylindrical opening 39, which extends vertically in the molded frame and into the housing opening 46*a*. The torsion rod 45 is sheathed within a plastic or like sleeve member 45*c* of the same cross-section as the spur gear housing 47*a* and the lower end of which is nested within the sleeve 39*a*.

In order to keep the door lites clear of exterior condensation and/or to clear interior condensation after the door has been opened, it is presently preferred that the inner surface 19*a* of the outer lite 19 (FIGS. 12, 13) is heated. Heating is accomplished by applying an electrical potential across a transparent, electrically conducting film on the inner surface 19*a*. Electricity is brought into the door D through the electrical connector section 32 of the plug-in key located on the hinge margin 35*a* of the door frame F. The electrical connector section 32 has a main oval body 32*c* molded into the frame F and having a female socket 32*a* that receives a typical male connector plug (not shown) from the merchandiser casing C. Electrical contacts of the male connector mate with prongs 32*b* located in the socket recess so that the door is plugged into the merchandiser as a source of electrical power (FIGS. 8, 13). The prongs are made of a suitable electrically conducting material, such as bronze. As shown in FIGS. 5, 5A, 6, 6A, 9 and 11, the electrical heating means for the door lite includes spring leaf contacts 50,50*a* which protrude from the inner locking body-side of the key 30 and extend in opposite directions. Preferably, these leaf contacts are made of a softer material, such as copper, and are connected to the respective prongs 32*b* through the inside of the key (FIG. 13). The leaf contacts may be made of the other electrically conductive materials and may be formed as one piece with the prongs.

Figure 11:
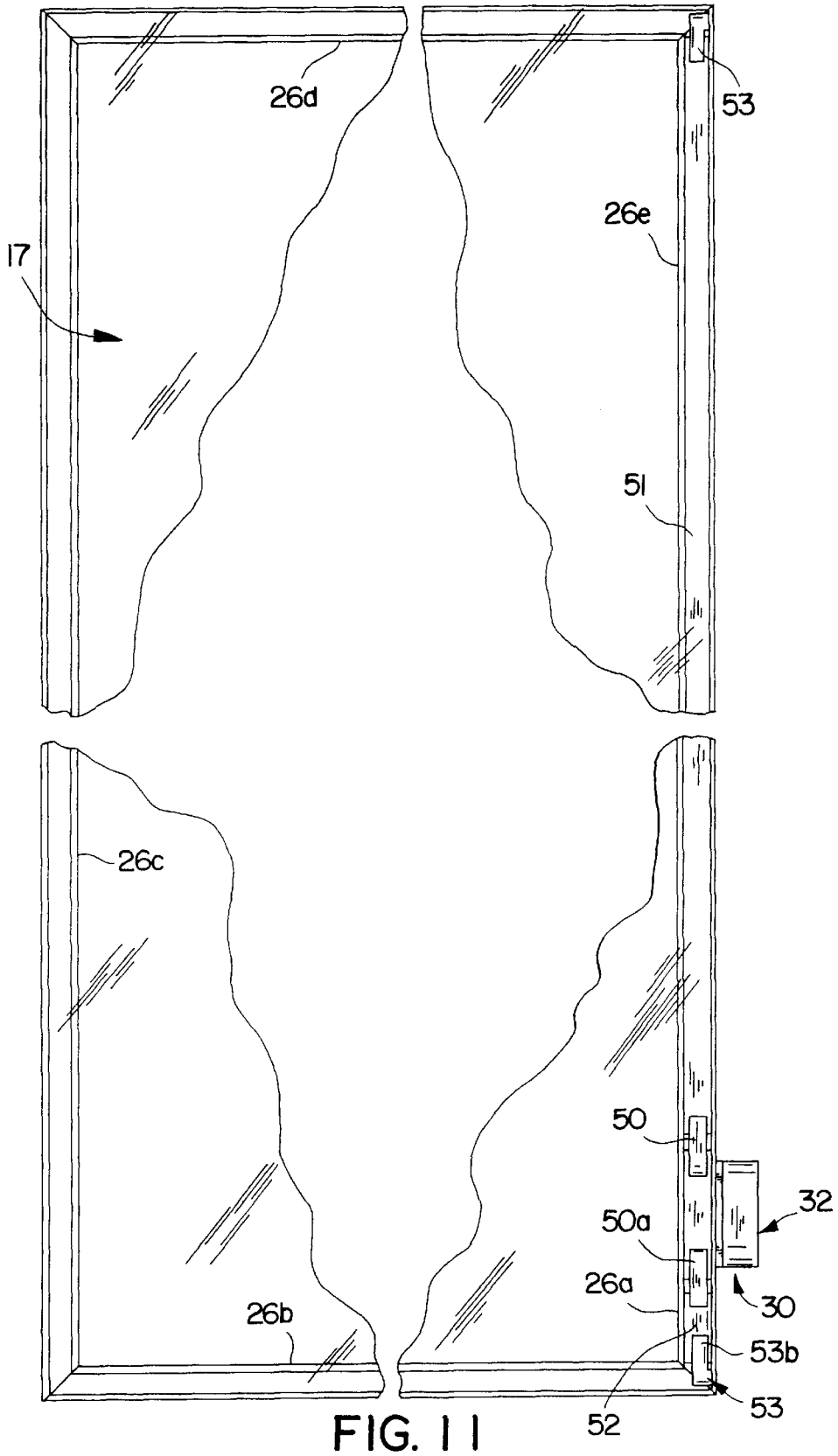
FIG. 11 is a view of the spacer as assembled around the glass lites, and illustrates electrical conductors on the spacer.

The leaf contacts 50,50*a* are pressed against the outer sides 21*a* of the inner spacer body 21 of the spacer by the inner lite 17, and against conductors 51,52 received in a recess or groove along the side 21*a* of the spacer body. The conductors are a copper foil in the preferred embodiment, but may be of another electrically conductive material. As shown in FIG. 11, a first of the conductors 51 extends from adjacent the electrical plug-in and spacer locking key 30 upwardly to the upper corner of the door frame, and a second of the conductors 52 extends from adjacent the electrical key downwardly to the lower corner of the door frame. The electrical conductors 51,52 are sandwiched between the electrically insulating inner surface 17*a* of the inner glass lite and the electrically insulating spacer. The molded frame F extends onto the inner lite 17 a distance greater than the depth of insertion of the spacer body 21 between the inner lite 17 and middle lite 18 so that the spacer is covered. Accordingly, the conductor is also covered by the molded frame which isolates it from sight and touch of the customer so that even if the outer lite should break, the conductor is still shielded between the frame and spacer from incidental contact.

Figure 12:
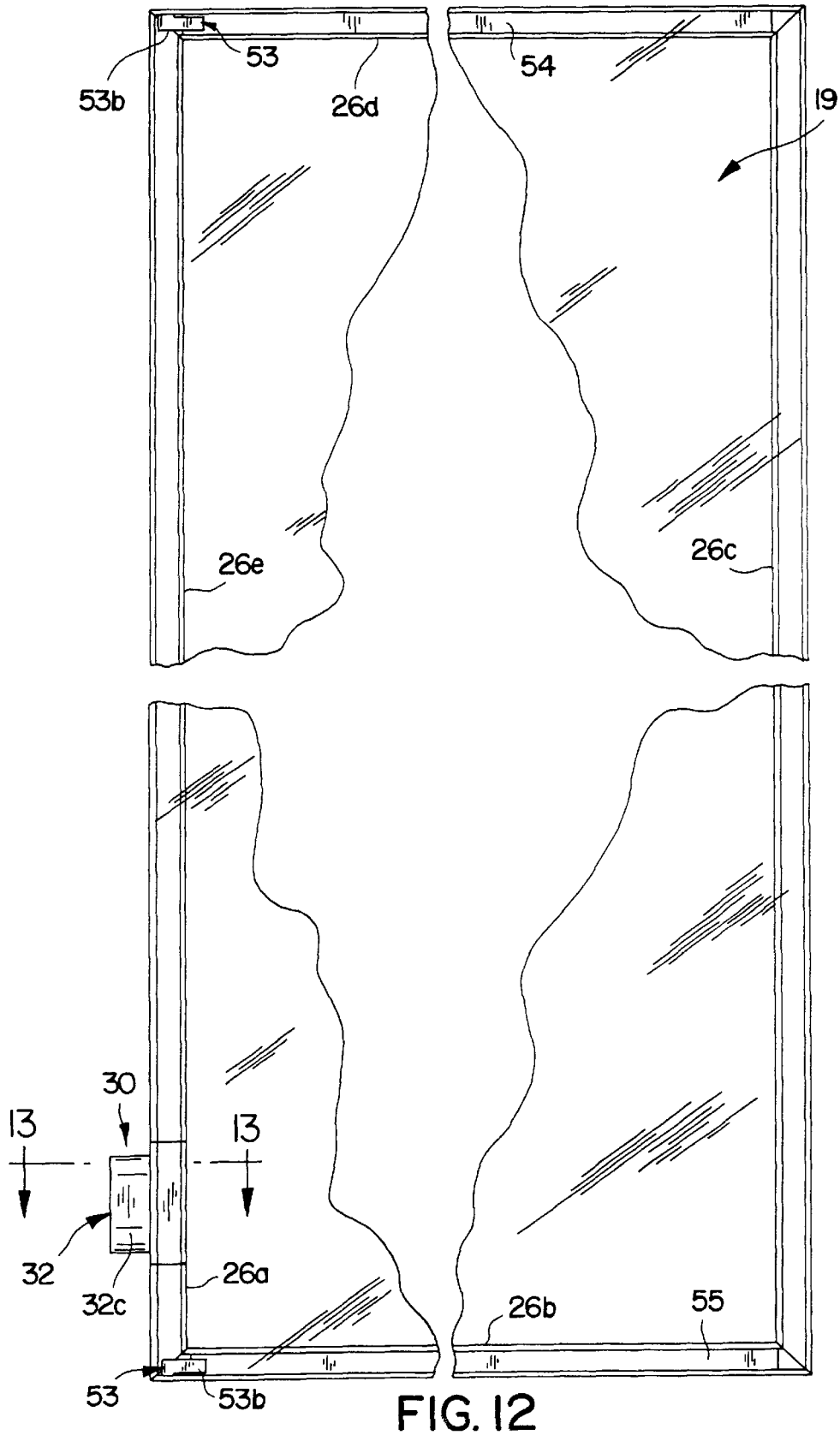
FIG. 12 is a view of the spacer and glass lites from the side opposite to FIG. 11 and illustrates bus bars on the spacer.
Figure 13:
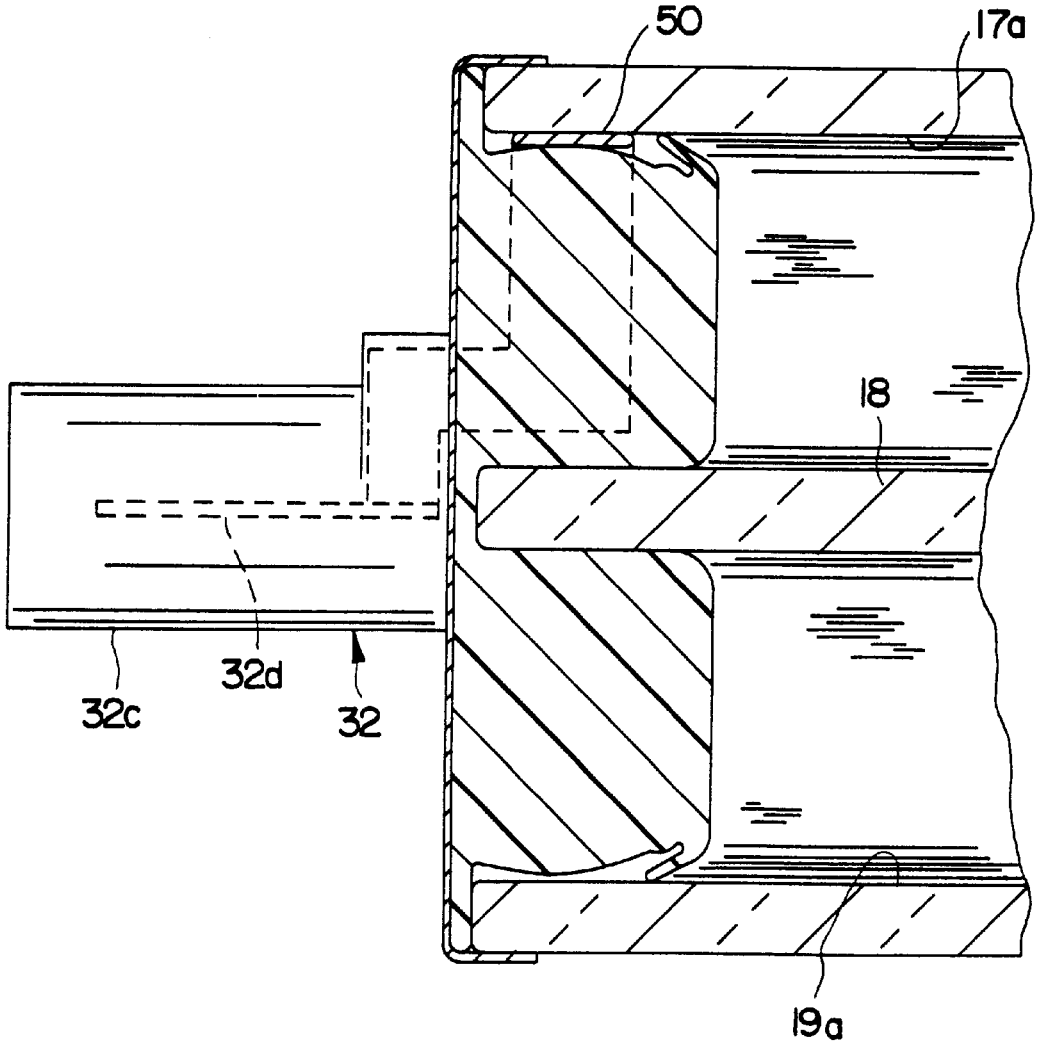
FIG. 13 is a fragmentary sectional view of the spacer taken in the plane including line 13—13 of FIG. 12.

At the upper and lower corners, respective crossover connectors 53 electrically connect the first conductor 51 to an upper bus bar 54 and the second conductor 52 to a lower bus bar 55 (FIG. 14), Referring to FIG. 12, the upper bus bar 54 extends between the spacer body 21 and the inner surface 19*a* of the outer lite 19 across the top of the door. Similarly, the lower bus bar 55 extends between the spacer body 21 and the inner surface 19*a* of the outer lite 19 across the bottom of the door. Each bus bar is a copper foil and is in contact with the conductive film on the inner surface of the outer lite so that the bus bars are able to apply an electrical potential between the top and bottom of the inner surface. The compressive force applied by the molded frame F, when formed, is sufficient to secure the electrical engagement of the bus bars 54,55 with the film on the outer lite 19. It is noted that the bus bars are screened from view and protected from incidental contact in the event the outer lite breaks.

Figure 14:
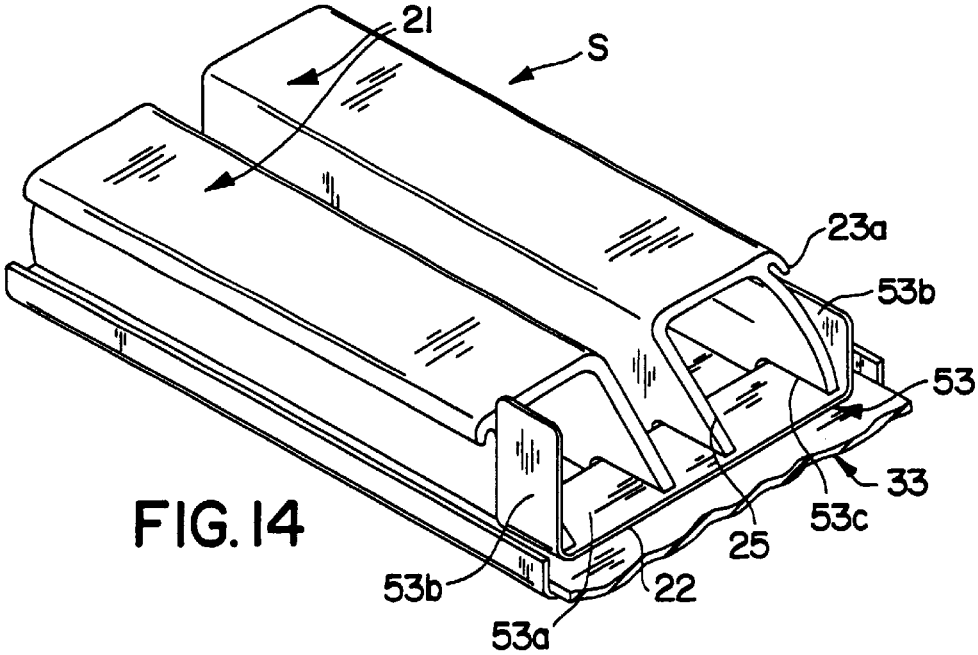
FIG. 14 is a fragmentary perspective view of a bottom corner portion of the spacer and illustrates a crossover connector.

As shown in FIG. 14, the crossover connectors 53 include a crosspiece 53*a* and end tabs 53*b* which are oriented at right angles to the crosspiece. The end tab 53*b* on one side of the spacer contacts the second conductor 52 running down from the electrical plug-in 30 and connects across the IG unit to the other end tab engaging the lower bus bar 55 (FIG. 12). The crosspiece 53*a* extends through the slots 53*c* formed at the notches 25 of the spacers (FIG. 4) to transfer the electricity across the insulated space between the inner lite 17 to the lower bus bar 55 connected with the electrically conductive film on the inner surface 19*a* of the outer lite 19. The crosspiece 53 at the top of the door similarly connects the conductor 51 on one side of the panel with the bus bar 54 on the outer lite. Thus, the crosspieces do not interfere with the right angle geometry and close fit of the spacers at the corners with the glass lites.

In another embodiment of the present invention, only the inner surface 17*a* of the inner lite 17 would be heated and thus the electrically conductive film would be applied to that surface (17*a*). In that event, the arrangement of the conductors 51,52 and bus bars 54,55 would be reversed from that described above and shown in the drawings (particularly FIGS. 11 and 12). The conductors 51,52 would be disposed between the outer lite 19 and the spacer body 21 adjacent the outer lite, and the bus bars 54,55 would be disposed between the inner surface 17*a* of the inner lite 17 and the spacer body adjacent thereto. In this embodiment, at least the middle lite 18 and possibly the outer lite would have a low emissivity material coating to further reduce heat transfer through the glass. In addition, the space between adjacent lites may be filled with a dry gas, such as Argon or Krypton, having low thermal conductivity. The increased thermal resistance of this arrangement reduces concern over condensation. Thus, the heated surface is shifted to the inside lite where it is still needed for door clearing. This embodiment is more energy efficient since only about half the power is required to clear the door in a commercially acceptable time.

Method for Making the Reach-In Door

The reach-in door of the present invention is assembled by first providing the various component parts, including the outer 19, middle 18 and inner 17 glass lites, the spacer S, electrical plug and spacer locking key 30, and torsion rod adjustment assembly (38*a*,38*b*,39*a*,45,45*c*,46,47,48) and reinforcing members 40*g*,43*a*. The inner surface 19*a* of the outer lite 19 is formed with a transparent, electrically conductive film. The lites are washed immediately prior to assembly, and the edge surfaces of the inner and outer lites 17,19 (which will be contacted by the molded frame material) are primed with a chemical adhesion promoter to promote bonding of the molded frame material (e.g., polyurethane) to the glass.

In providing the component parts, the spacer S is extruded from a polymer or other suitable material having an appropriate Underwriter's Laboratories rating. The polymer material selected should have thermal and electrical insulating properties and produce minimal chemical fogging of the glass surfaces. The spacer strip S is angle cut with the notches 25 through the separator body portion 21 to define the body sections or segments that correspond to the respective lengths of the glass lite sides, with the free end segments 26*a* being over-length. The strip is also slotted, at 53*c*, to later accommodate the cross-over connectors 53, and the holes 24*b* are formed in the inner free side of the body segments. Also, at least one of the hollow body segments is filled, as needed, with desiccant 24*a*, and the ends of such segments are plugged or taped to retain the desiccant. The copper foil bus bars 54,55 are adhered to the side of the spacer body segments 26*d*,26*b* which will ultimately extend across the top and bottom of the door in contact with conductive film on the inner surface 19*a* of the outer lite 19. It is also permissible to adhere the bus bars 54, 55 directly to the glass, although assembly is believed to be simplified by providing them on the spacer. The copper foil conductors 51,52 are also affixed to the opposite side of the spacer body segments 26*a*,26*e* which will engage the inner surface 17*a* of the inner lite 17 along the hinged edge margin of the door D, when assembled.

In a three-lite panel, the spacer S is then folded or wrapped around the middle glass lite 18, the marginal edge of which is received in the central groove between the opposed side walls 21*a* of the spacer bodies 21 and abutting against the connecting web 22*a* of the outer wall 22. The spacer is constructed and arranged so that the corners of the glass correspond to the notches 25 in the spacer to permit the spacer to be bent 90° and fit together and mate in the manner of a mitered corner, so that they extend substantially uninterruptedly through the corners. The spacer is constructed and arranged such that it extends nearly the entire distance around the perimeter of the middle lite 18. However, the free ends 25*a* of spacer sections 26*a*,26*e* will be spaced apart to permit the interlocking connection by the locking plugs 31*c* of the spacer locking key 31. These plug-in tabs 31*c* are inserted into the hollow openings 24 at the opposing ends 25*a* of the spacer, and the detents 31*e* on the keys 31*c* snap into the openings 31*d* in the spacer for locking engagement.

The inner and outer lites 17,19 are then inserted into the initial unit formed by the spacer S and middle lite 18. The inner and outer lites fit against respective spacer bodies 21 and the outer marginal edges 23 of these lites are received under the flanges 22*b* of the spacer. If the tape 33 is not pre-applied to the spacer wall 22, then the moisture barrier tape 33 is now applied to the respective side stretches of the wall 22 and turned to extend over slightly (e.g., approximately 0.10 inches) onto the outer lite surfaces. The taping step is done to make certain that the spacers are sealed with the lites especially at the corners to prevent intrusion of molded frame material between the lites. Pre-application of moisture barrier tape can be eliminated in favor of a taping step after the spacer has been applied to capture the glass lites and form the basic IG unit. In that event, the taping would be extended over the entire length of the spacer, and especially at the corners. In addition, tape is placed around the electrical plug-in and spacer locking key 31. A portion of the tape 33 has been broken away in FIGS. 5 and 5A and 12 to illustrate its presence. In addition, a strand or rope of sealant (e.g., polyisobutylene) may be wrapped around the socket 32*a* of the electrical key 32 to promote bonding and sealing between the electrical key portion 32 and the molded frame material.

The captured spacer and glass lites subassembly is placed into a mold (not shown) for forming the door frame. In addition, the reinforcing members 40*g*,43*a*, including the hinge pin bushings 38*a*,39*a* are positioned in the mold, as is the torque adjustment housing 46. The bushing 39*a* associated with the lower hinge pin 43 is accompanied by a sleeve 45*c* which houses the torsion rod 45 below the torque adjustment housing 46. Suitable bushings (not shown) are placed in the mold for the door handle H, and other suitable fixtures or disposable members are provided to form other openings and spaces for reducing space or otherwise as needed. The mold is closed and the molded frame F is formed by introducing one or more shots of liquid polyurethane frame material or the like into the mold cavity. The desiccant in the spacer bodies 21 may in certain circumstances provide structural integrity for the spacer bodies of the spacer during molding. The construction and arrangement of parts within the mold is designed to prevent the incursion of door frame material to circumvent the spacer and enter the spaces between the lites 17,18,19. Such an incursion would produce an aesthetically unacceptable product. The sealing lips 21*c* on the spacer bodies also provide protection against door frame material moving past the spacer, tending to block further movement of any material which manages to enter under the flange 22*b* between the lites and the spacer body. A period is allowed for demolding and the mold is opened. Known procedures may be used to provide protection for the molded frame against ultraviolet degradation.

The interior of the captured glass panel subassembly (i.e. the spaces between adjacent lites 17,18 and 19) is sealed by the bonding action of the molded frame F around and onto the inner and outer lites 17,19. The "air" spaces between the panes of glass may be selectively filled with an a dry gas, such as Argon or Krypton having low thermal conductivity. The torsion rod 45 with spur gear 47 (and lower hinge pin 43) are slid into the sleeve member 45*c* and housing chamber 47*a* with the sleeve 39*b* being positioned inside the bushing 39*a*. The torque adjustment worm gear 48 is mounted in the torque adjustment housing 46 and is meshed with the spur gear 47*b* on the upper end of the torsion rod, and the cover plate 46*b* is secured. The sleeve 38*b* is inserted in the upper bushing 38*a*, and the spring 40*a* and upper hinge pin 40 are now received in the sleeve 38*b* and bushing 38*a* at the top of the door. The handle H is also attached to the door, the magnetic strip holder 20 (including the magnetic strip) is inserted into the groove 20*b* and other hardware applied. It is to be understood that fewer than all of the foregoing steps may occur at one manufacturing location. For instance, the spacer could readily be produced at a remote location and shipped to the final assembly site.

The present reach-in door D for a merchandiser M therefor has excellent thermal insulation and product display qualities, and achieves the other objects set out for the invention. Moreover, assembly of the door is carried out with a limited number of steps. It is to be understood that the foregoing description and accompanying drawing have been given only by way of illustration and example, and that changes and modifications in the present disclosure, which will be readily apparent to all skilled in the art, are contemplated as within the scope of the present invention, which is limited only by the scope of the appended claims.

What is claimed is:

1. A method of making a transparent reach-in door for a refrigerated product merchandiser, comprising the steps of:

providing a thermally and electrically insulating spacer member having an inner central separator body portion with an outer wall forming side sealing flanges on each side of the body portion;

applying a locking key member to secure the ends of the spacer member to thereby define a continuous peripheral edging for a glass panel subassembly;

forming an unsealed captured glass panel subassembly by:

(1) preassembling the spacer member on first and second glass lites with the separator body portion engaging the opposed inner surfaces of the glass lites and the peripheral margins of the lites being captured by the sealing side flanges of the spacer member to form the glass panel subassembly; and (2) applying a moisture barrier material to the outer wall surface of the spacer and locking key members; and molding a non-metal frame to peripherally encase and seal the captured glass panel subassembly to form a reach-in door having opposed vertical inner hinge and outer handle side edges.

2. The method of claim 1, including providing heating means on the inner surface of one of the first and second glass lites, and providing an electrical connection to the heating means through the locking key member.

3. The method of claim 2, including positioning the one glass lite having the inner surface heating means to be on the outer side of the door remote from the product merchandiser.

4. The method of claim 2, including positioning the one glass lite having the inner surface heating means to be located on the inner side of the door nearest to the product merchandiser.

5. The method of claim 4 in which the other of said first and second glass lites is formed of low-E glass.

6. The method of claim 5, including providing three glass lites captured and spaced by the spacer member and of which the middle glass lite is the other glass lite.

7. The method of claim 2, in which the electrical connection through the locking key member provides a pair of electrical leads, and including the step of orienting the key member leads to extend in opposite vertical directions, and adhering conductive connector means to extend the key member leads to the opposed top and bottom margins of the panel.

8. The method of claim 7 wherein said conductive connector means includes conductors and bus bars, the step of adhering the conductive connector means comprises the step of adhering the conductors to the separator body portion along one of the sides of the spacer member prior to preassembling the spacer member with the glass lites.

9. The method of claim 8, including locating the conductors along a remote side of the spacer member from te one glass lite having heating means on its inner surface.

10. The method of claim 9 wherein the step of adhering said conductive connector means comprises the step of adhering the bus bars to the opposed top and bottom margins of the separator body portion along the side of the spacer member in contact with the one glass lite.

11. The method of claim 10 comprising the step of placing crossover connector means in the spacer member in a position for making electrical contact between the conductors and the bus bars.

12. The method of claim 2 wherein the step of preassembling the spacer member on the first and second glass lites further includes first assembling a third lite with the spacer member in position to be located between the first and second lites.

13. The method of claim 12 including forming the third lite from low-E glass.

14. The method of claim 13 including positioning one of the first and second lites on the side of the third lite nearest to the product merchandiser.

15. The method of claim 1 wherein the step of applying the moisture barrier material further includes applying the moisture barrier material so as to overlap a predetermined outer surface area of said glass lites adjacent to the peripheral marginal edges thereof.

16. The method of claim 15 including selectively applying sealant to the locking key member to promote bonding and sealing thereof to the molded frame.

17. The method of claim 1 wherein the step of molding the non-metal frame includes molding horizontally extending reinforcing means into the frame adjacent to said inner hinge side edge for reinforcing the hinged connection of the door when installed on a product merchandiser.

18. The method of claim 1 further comprising an assembly step following said molding step of inserting torsion means and torque adjustment means for said torsion means into the molded frame whereby adjustment of the closing force applied to the door by said torsion means may be adjusted by accessing the torque adjustment means on the door frame.

19. The method of claim 1 further comprising the steps of:

locating the first glass lite so that in use of the door on the merchandiser the first glass lite is positioned nearest to the product area of the merchandiser and locating the second lite in an outwardly spaced relation with the first lite, forming one of said first and second glass lites from a low-E glass and forming a heat conductive film on the other of said lites.

20. The method of claim 19 in which said first lite is said other of said lites, and forming the heat conductive film on the interiorly facing surface of said first lite opposed to said second lite.

21. The method of claim 20 including providing a third glass lite on the panel outwardly of the first and second glass lites whereby the middle glass lite of the panel is formed of low-E glass.

22. The method of claim 1 further comprising the step of applying a moisture barrier material to overlap a predetermined outer surface area of said glass lites adjacent to the peripheral marginal edges thereof.

23. The method of claim 1 wherein the step of molding the non-metal frame includes molding horizontally extending reinforcing means into the frame adjacent to said inner hinge side edge for reinforcing the inner hinged side of the door when installed on a product merchandiser.

24. The method of claim 1 further comprising an assembly step following said molding step of inserting torsion means and torque adjustment means for said torsion means into the molded frame whereby adjustment of the closing force applied to the door by said torsion means may be adjusted by accessing the torque adjustment means on the door frame.

25. The method of forming a non-metallic, thermally insulated, transparent door for a reach-in merchandiser, in which said door has first and second glass lites, comprising the steps of:

providing a thermally and electrically insulating one-piece spacer member having an outer wall portion and a separator body portion projecting from the inner side of the wall portion and forming a sealing flange on an outer side along the body portion;

forming angled notches in the separator body portion to define the respective corners of the first and second glass lites;

folding the spacer member at the angled notches to extend along-the sides of one of the glass lites with the body portion in surface contact with the inner surface of the first glass lite and the sealing flange in engagement with the adjacent marginal edges thereof;

bringing the free ends of the spacer member into juxtaposition and securing them together with locking means for holding the spacer member in assembled peripheral contact around the one glass lite;

positioning the other glass lite in surface contact with the body portion of the spacer member and spaced relation with the one glass lite to form a glass subassembly of said spacer with the first and second glass lites; and molding a non-metallic frame of a preselected plastic material to peripherally encase the subassembly of glass lites and spacer member and create an air-tight seal therearound.

26. The method of claim 25 in which the plastic material is polyurethane.

27. The method claim of claim 25 in which the glass subassembly is unsealed against fluid passage prior to the molding step, and the method includes the step of assembling a moisture barrier material to cover the outer wall portion of the spacer member.

28. The method of claim 27 in which the step includes shaping the moisture barrier material to overlap the peripheral edges of the glass lites adjacent to the outer wall portion of the spacer member.

29. The method of claim 25 in which said locking means comprises a locking key member and includes the step of engaging the free spacer member ends in locked position on the key member and forming a matching continuation of the spacer member outer wall configuration across the key member.

30. The method of claim 29, including the step of covering the outer wall portion of the spacer member and the matching key member configuration with a moisture barrier material.

31. The method of claim 29, including positioning the locking key member to lockingly engage the free spacer member ends together on the hinge side of the door, and providing the locking key member with electrical connection means for the door.

32. The method of claim 31, in which the glass panel subassembly includes heating means on the inner surface of the first glass lite and the electrical connection means of the key member includes a pair of electrical leads, and including the step of orienting the key member leads to extend along a vertical side of the spacer body portion adjacent to the second glass lite, and adhering conductive connector means to engage and extend the key member leads to the horizontal top and bottom sides of the second glass lite.

33. The method of claim 32 wherein said conductive connector means includes conductors and bus bars, the step of adhering the conductive connector means comprises the step of adhering the conductors to the vertical side of the separator body portion of the spacer member prior to assembling the spacer member with the glass lites.

34. The method of claim 33 wherein the step of adhering said conductive connector means comprises the step of adhering the bus bars to the top and bottom sides of the separator body portion of the spacer member to be oriented against the heating means on the first glass lite.

35. The method of claim 34 comprising the step of placing crossover connector means in the spacer member in a position for making electrical contact between the conductors and the bus bars.

36. The method of claim 25 wherein the step of assembling the spacer member on the first and second glass lites further includes the step of assembling a third lite with the spacer member to be in spaced relation with the first and second lites.

37. The method of claim 36 including forming the third lite from low-E glass.

38. The method of claim 25 wherein the step of molding the non-metal frame includes molding horizontally extending reinforcing means into the frame adjacent to the hinge side of the door for reinforcing a hinged connection of the door to the merchandiser.

39. The method of claim 25 further comprising an additional step following said molding step of providing means to create openings in the molded frame for accommodating door hardware, and inserting torsion means and torque adjustment means for said torsion means into the molded frame openings.

40. A method of making a transparent door adapted for use on a refrigerated enclosure and having at least two glass lites that are thermally and electrically encased within a non-metallic molded frame, comprising the steps of:

providing a thermally and electrically insulating one-piece spacer member having a continuous flat outer wall section and a separator body section projecting inwardly therefrom, and which wall section also forms a sealing flange on each side of the body section;

forming spaced angled notches in the separator body section to define body section segments corresponding to the respective sides of the glass lites;

folding the spacer member at the angled notches around one of the glass lites to mate the body section segments at the corners and lie in surface contact along the inner surface of the one glass lite;

bringing the free ends of the spacer member into juxtaposition and securing them together with locking means for holding the spacer member in assembled peripheral contact around the one glass lite;

assembling an other glass lite in surface contact with the body section of the spacer member and in spaced relation with the one glass lite; and with the sealing flange of the spacer member wall section being engaged peripherally along the adjacent marginal edge of the other glass lite;

covering the outer wall section with a moisture barrier material; and molding an outer door frame of non-metallic, electrically non-conductive material to peripherally encase the assembled glass lites and spacer member and create an air-tight seal therebetween.

41. The method of claim 40 in which the one glass lite is formed from low-E glass.

42. The method of claim 40 in which the other glass lite has a heat conductive film on its interiorly facing surface.

43. A method of making a transparent reach-in door for a refrigerated product merchandiser, comprising the steps of:

providing a thermally and electrically insulating spacer member having an inner central separator body portion with an outer wall forming extended side sealing flanges on each side of the body portion;

forming an unsealed glass panel subassembly by preassembling the spacer member around first and second glass lites with the separator body portion engaging the opposed inner surfaces of the glass lites and the peripheral margins of the lites being engaged by the side sealing flanges of the spacer member to form a captured glass panel subassembly; and molding an outer non-metal frame to peripherally encase and seal the captured glass panel subassembly to form a reach-in door.

44. The method of claim 43 further comprising the steps of:

locating the first glass lite so that in use of the door on the merchandiser the first glass lite is positioned nearest to the product area of the merchandiser and locating the second lite in an outwardly spaced relation with the first lite, forming one of said first and second glass lites from a low-E glass and forming a heat conductive film on the other of said lites.

45. The method of claim 43 in which said first lite is said other of said lites, and forming the heat conductive film on the interiorly facing surface of said first lite opposed to said second lite.

46. The method of claim 45 including providing a third glass lite on the panel outwardly of the first and second glass lites whereby the middle glass lite of the panel is formed of low-E glass.

47. The method of claim 43 including applying a locking member to secure the ends of the spacer members, thereby defining a continuous peripheral edging for the glass panel subassembly, and providing heating means on the inner surface of one of the first and second glass lites, and providing an electrical connection to the heating means through the locking key member.

48. The method of claim 43 wherein the step of preassembling the spacer member on the first and second glass lites further includes first assembling a third lite with the spacer member in position to be located between the first and second lites.

49. The method of making a refrigerated merchandiser having a product area, comprising the steps of:

constructing a casing defining the product area therein and having an opening for accessing the product area;

constructing and arranging the door to have a transparent panel with first and second glass lites, mounting the door on the casing generally over the opening such that the first glass lite is nearest to the product area and the second lite is in an outwardly spaced relation with the first lite, forming the second glass lite from a low-E glass and forming a heat conductive film on the first glass lite.

50. The method of claim 49 wherein said step of forming the heat conductive film comprises forming the film on the interiorly facing surface of said first lite opposed to said second lite.

51. The method of claim 49 including providing a third glass lite on the panel outwardly of the first and second glass lites whereby the middle glass lite of the panel is formed of low-E glass.

* * * * *